US009057994B2

(12) United States Patent
Rogers et al.

(10) Patent No.: US 9,057,994 B2
(45) Date of Patent: Jun. 16, 2015

(54) HIGH RESOLUTION PRINTING OF CHARGE

(75) Inventors: John Rogers, Champaign, IL (US); Jang-Ung Park, Ulsan Metropolitan (KR)

(73) Assignee: The Board of Trustees of the University of Illinois, Urbana, IL (US)

( * ) Notice: Subject to any disclaimer, the term of this patent is extended or adjusted under 35 U.S.C. 154(b) by 731 days.

(21) Appl. No.: 12/947,120

(22) Filed: Nov. 16, 2010

(65) Prior Publication Data

US 2011/0170225 A1 Jul. 14, 2011

Related U.S. Application Data

(60) Provisional application No. 61/293,258, filed on Jan. 8, 2010.

(51) Int. Cl.

| | |
|---|---|
| ***B41J 2/015*** | (2006.01) |
| ***G03G 15/32*** | (2006.01) |
| ***B41J 2/06*** | (2006.01) |

(52) U.S. Cl.
CPC *G03G 15/323* (2013.01); *B41J 2/06* (2013.01)

(58) Field of Classification Search
USPC ..... 347/20
See application file for complete search history.

(56) References Cited

U.S. PATENT DOCUMENTS

| | | | | |
|---|---|---|---|---|
| 3,949,410 | A | 4/1976 | Bassous et al. | |
| 4,658,269 | A | 4/1987 | Rezanka | |
| 5,790,151 | A | 8/1998 | Mills | |
| 5,838,349 | A | 11/1998 | Choi et al. | |
| 6,276,775 | B1 | 8/2001 | Schulte | |
| 6,451,191 | B1 | 9/2002 | Bentsen et al. | |
| 6,742,884 | B2 | 6/2004 | Wong et al. | |
| 7,158,277 | B2 | 1/2007 | Berggren et al. | |
| 7,641,325 | B2 * | 1/2010 | Steiner et al. | 347/76 |
| 2005/0116069 | A1 * | 6/2005 | Murata | 239/690 |
| 2006/0102525 | A1 | 5/2006 | Volkel et al. | |
| 2006/0163759 | A1 * | 7/2006 | Maruyama et al. | 261/137 |
| 2007/0064068 | A1 | 3/2007 | Piatt et al. | |
| 2011/0187798 | A1 * | 8/2011 | Rogers et al. | 347/55 |

FOREIGN PATENT DOCUMENTS

| | | |
|---|---|---|
| EP | 1 477 230 | 11/2004 |
| WO | WO 2009/011709 | 1/2009 |

OTHER PUBLICATIONS

Afzali et al. (Web Release Jul. 9, 2002) "High-Performance, Solution-Processes Organic Thin Film Transistors from a Novel Pentacene Precursor," *J. Am. Chem. Soc.* 124(30):8812-8813.

(Continued)

*Primary Examiner* — Uyen Chau N Le
*Assistant Examiner* — Chad Smith
(74) *Attorney, Agent, or Firm* — Lathrop & Gage LLP

(57) ABSTRACT

Provided are methods of printing a pattern of charge on a substrate surface, such as by electrohydrodynamic (e-jet) printing. The methods relate to providing a nozzle containing a printable fluid, providing a substrate having a substrate surface and generating from the nozzle an ejected printable fluid containing net charge. The ejected printable fluid containing net charge is directed to the substrate surface, wherein the net charge does not substantially degrade and the net charge retained on the substrate surface. Also provided are functional devices made by any of the disclosed methods.

33 Claims, 23 Drawing Sheets

(56) References Cited

OTHER PUBLICATIONS

Ahn et al. (2007) "Iterative Learning Control: Brief Survey and Categorization, Systems, Man, and Cybernetics, Part C: Applications and Reviews," *IEEE Transactions* 37(6):1099-1121.
Anagnostopoulos et al. (2003) "Micro-Jet Nozzle Array for Precise Droplet Metering and Steering Having Increased Droplet Deflection," 12th Int. Conf. on Solid State Sensors, Actuators and Microsystems (Boston, MA) 1:368-371.
Arias et al. (2004) "All Jet-Printed Polymer Thin-Film Transistor Active-Matrix Backplanes," *Appl. Phys. Let*. 85(15):3304-3306.
Arimoto et al. (1984) "Bettering Operation of Robots by Learning," *J. Robotic Syst*. 1(2):123-140.
Babel et al. (Web Release Apr. 27, 2005) "Electrospun Nanofibers of Blends of Conjugated Polymers: Morphology, Optical Properties, and Field-Effect Transistors," *Macromolecules* 38(11):4705-4711.
Barry et al. (Web Release Aug. 27, 2005) "Charging Process and Coulomb-Force-Directed Printing of Nanoparticles with Sub-100-nm Lateral Resolution," *Nano Lett*. 5(10):2078-2084.
Barton et al. (Aug. 2010) "A Desktop Electrohydrodynamic Jet Printing System," *Mechatronics* 20(5):611-616.
Barton K., (Mar. 2010) "Electrohydrodynamic Jet Printing System," Lemelson-Illinois Student Prize Finalist.
Barton et al. (Mar. 2010) "E-Jet Printing," Power Point Presentation, Industry Advisory Board Meeting for Nano-Learning Center.
Bassous et al. (1977) "Ink Jet Printing Nozzle Arrays Etched in Silicon," *Appl. Phys. Lett*. 31(2):135-137.
Bean, K.E. (1978) "Ansiotropic Etching of Silicon," *IEEE Trans. Electron Dev*. 25(10):1185-1193.
Bharathan et al. (1998) "Polymer Electroluminescent Devices Processed by Inkjet Printing: I. Polymer Light-Emitting Logo," *Appl. Phys. Lett*. 72(21):2660-2662.
Bietsch et al. (2004) "Rapid Functionalization of Cantilever Array Sensors by Inkjet Printing," *Nanotechnology* 15:873-880.
Blazdell et al. (1999) "Preparation of Ceramic Inks for Solid Freeforming Using a Continuous Jet Printer," *J. Mater. Syn. Process*. 7(6):349-356.
Blazdell et al. (1995) "The Computer Aided Manufacture of Ceramics Using Multilayer Jet Printing," *J. Mater. Sci. Lett*. 14(22):1562-1565.
Boning et al. (Oct. 1996) "Run by Run Control of Chemical-Mechanical Polishing," *IEEE Trans. Comp. Packag. Manufact. Technol. C* 19(4):307-314.
Bristow et al. (2006) "A High Precision Motion Control System with Application to Microscale Robotic Deposition," *IEEE Trans. Control Systems Technol*. 26(3):96-114.
Bristow et al. (2006) "A Survey of Iterative Learning Control," *Control Systems Magazine, IEEE* 26(3):96-114.
Burns et al. (2003) "Inkjet Printing of Polymer Thin-film Transistor Circuits," *MRS Bulletin*, 28:829-834.
Calvert (2001) "Inkjet Printing for Materials and Devices," *Chem. Mater*. 13(10):3299-3305.
Chabinyc et al. (2005) "Printing Methods and Materials for Large-Area Electronic Devices," *Proceedings of the IEEE* 93(8):1491-1499.
Chang P. C. et al. (2004) "Film morphology and Thin Film Transistor Performance of Solution-Processed Oligothiophenes," *Chem. Mater*. 16:4783-4789.
Chang et al. (2006) "Inkjetted Crystalline Single Monolayer Oligothiphene OTFTs," *IEEE Trans. Electron. DEv*.53(4):594-600.
Chang, S. C. et al. (1999) "Multicolor Organic Light-Emitting Diodes Processed by Hybrid Inkjet Printing," *Adv. Mater*. 11:734-737.
Chang et al. (1998) "Dual-Color Polymer Light-Emitting Pixels Processed by Hybrid Inkjet Printing," *Appl. Phys. Lett*. 73(18):2561-2563.
Chen et al. (2006) "Scaling Law for Pulsed Electrohydrodynamic Drop Formation," *Appl. Phys. Lett*. 89:124103.
Chen et al. (2005) "The Role of Metal—Nanotube Contact in the Performance of Carbon Nanotube Field Effect Transistors," *Nano Lett*. 5:1497-1502.
Chen et al. (1997) "An Iterative Learning Control in Rapid Thermal Processing," In: Proc. the IASTED Int. Conf. on Modeling, Simulation and Optimization (MSO'97), Singapore pp. 189-192.
Chen et al. (Web Release Apr. 13, 2006) "Electrohydrodynamic 'Drop-and-Place' Particle Deployment," *Appl. Phys. Lett*. 88:154104.
Cheng K. et al. (2005) "Inkjet Printing, Self-Assembled Polyelectrolytes, and Electroless Plating: Low Cost Fabrication of Circuits on a Flexible Substrate at Room Temperature," *Macromol. Rapid Commun*. 26:247-264.
Cheung et al. (2002) 2nd Ann. Int. Conf. on Microtechnologies in Medicine and Biology (Madison, WA, USA) pp. 71-75.
Choi et al. (2008) "Scaling Laws for Jet Pulsations Associated with High-Resolution Electrohydrodynamic Printing," *Appl. Phys. Lett*. 92(12):123109.
Cloupeau et al. (Sep. 1994) "Electrohydrodynamic Spraying Functioning Modes: A Critical Review," *J. Aerosol Sci*. 25(6):1021-1036.
Collins et al. (Web Release Dec. 2007) "Electrohydrodynamic Tip Streaming and Emission of Charged Drops from Liquid Cones," *Nat. Phys*. 4:149-154.
Creagh et al. (2003) "Design and Performance of Inkjet Printheads for Non Graphic Arts Applications," *MRS Bulletin* 28:807-811.
Dearden et al. (2005) "A Low Curing Temperature Curing Temperature Silver Ink for Use in Inkjet Printing and Subsequent Production of Conductive Tracks," *Macromol. Rapid Commun*. 26:315-318.
Del Castillo et al. (1997) "Run-to-run Process Control: Literature Review and Extensions," *J. Quality Technol*. 29(2):184-196.
Del Castillo et al. (1998) "An Adaptive Run-to-Run Optimizing Controller for Linear and Nonlinear Semiconductor Process," *IEEE Trans Semiconductor Manufacturing* 11(2):285-295.
Duke et al. (Mar. 10, 2002) "The Surface Science of Xerography," *Surf. Sci*. 500:1005-1023.
Farooqui et al. (1992) "Microfabrication of Submicron Nozzles in Silicon Nitride," *J. Microelectromech. Syst*. 1(2):86-88.
Forrest S. R. (2004) "The Path to Ubiquitous and Low-Cost Organic Electronic Applications on Plastics," *Nature*, 428:911-918.
Gans et al. (2004) "Inkjet Printing of Polymers: State of the Art and Future Development," *Adv. Mater*. 16:203-213.
Genda et al. (2004) "Micro-Patterned Electret for High Power Electrostatic Motor," 17th IEEE International Conference on Micro Electro Mechanical Systems, pp. 470-473.
Gomez et al. (1994) "Charge and Fission of Droplets in Electrostatic Sprays," *Phys. Fluids* 6(1):404-414.
Graham-Rowe, D. (Sep. 13, 2007) "Nanoscale Inkjet Printing," *Technology Review* published by MIT, http://technologyreview.com/computing/19373/page1/.
Han et al. (May 2002) "Tool Path-Based Deposition Planning in Fused Deposition Process," *J. Manuf. Sci. Eng*. 124(2):462-472.
Hayati et al. (Jan. 2, 1986) "Mechanism of Stable Jet Formation in Electrohydrodynamic Atomization," *Nature* 319:41-42.
Hayati et al. (1987) "Investigations Into Mechanisms of Electrohydrodynamic Spraying of Liquids," *J. Colloid Interf. Sci*. 117:205-221.
Hayes et al. (1998) "Micro-Jet Printing of Polymers and Solder for Electronics Manufacturing," *J. Electron. Manufac*. 8:209-216.
Hebner et al. (1998) "Local Tuning of Organic Light-Emitting Diode Color by Dye Droplet Application," *Appl. Phys. Lett*. 73:1775-1777.
Heller M. J. (2002) "DNA Microarray Technology: Devices, Systems, and Applications," *Ann. Rev. Biomed. Eng*. 4:129-153.
Hiller et al. (2002) "Reversibly Erasable Nanoporous Anti-Reflection Coatings from Polyelectrolyte Multilayers," *Nature Mater*. 1:59-63.
Huang et al. (Web Release Dec. 11, 2006) "Organic Field-Effect Inversion-Mode Transistors and Single-Component Complementary Inverters on Charges Electrets," *J. Appl. Phys*. 100:114512.
Huang et al. (Jan. 2007) "Organic Field-Effect Transistors and Unipolar Logic Gates on Charged Electrets from Spin-On Organosilsesquioxane," *Adv. Funct. Mater*. 17(1):142-153.
International Search Report and Written Opinion, Corresponding to International Application No. PCT/US07/77217, Mailed Jun. 3, 2008.

(56) References Cited

OTHER PUBLICATIONS

Jacobs et al. (2001) "Submicrometer Patterning of Charge in Thin-Film Electrets," *Science* 291:1763-1766.
Jacobs et al. (Web Release Nov. 4, 2002) "Approaching Nanozerography: The Use of Electrostatic Forces to Position Nanoparticles with 100nm Scale Resolution," *Adv. Mater*. 149(21):1553-1557.
Jaworek et al. (Oct. 1996) "Forms of the Multijet Mode of Electrohydrodynamic Spraying," *J. Aerosol Sci*. 27(7):979-986.
Jayasinghe et al. (2004) "Electric-Field Driven Jetting from Dielectric Liquids," *Appl. Phys. Lett*. 85:4243-4245.
Jayasinghe et al. (2006) "Electrohydrodynamic Jet Processing: An Advanced Electric Field-Driven Jetting Phenomenon for Processing Living Cells," *Small* 2:216-219.
Jayasinghe (2006) "Stable Electric-Field Driven Cone-Jetting of Concentrated Biosuspensions," *Lab Chip*. 6:1086-1090.
Jung et al. (2000) Fabrication of a Nanosize Metal Aperture for a Near Field Scanning Optical Microspray Sensor Using Photoresist Removal and Sputtering Techniques, *J. Vac. Sci. Technol. A* 18:1333-1337.
Juraschek et al. (Aug. 3, 1998) "Pulsation Phenomena During Electrospray Ionization," *Int. J. Mass Spectrom*. 177(1):1-15.
Kang et al. (Apr. 2007) "High Performance Electronics Using Dense, Perfectly Aligned Arrays of Single Walled Carbon Nanotubes," *Nature Nanotech*. 2:230-236.
Kawamoto et al. (2005) "Fundamental Investigation on Electrostatic Ink Jet Phenomena in Pin-to-Plate Discharge System," *J. Imaging Sci. Technol*. 49:19-27.
Khatavkar et al. (2005) "Diffuse Interface Modeling of Droplet Impact on a Pre-Patterned Solid Surface," *Macromol. Rapid Commun*. 26(4):298-303.
Kim et al. (Sep. 2008) "Electrohydrodynamic Drop-On-Demand Patterning in Pulsed Cone-Jet Mode at Various Frequencies," *J. Aerosol Sci*. 39(9):819-825.
Kim W. et al. (2005) "Electrical Contacts to Carbon Nanotubes Down to 1nm in Diameter," *Appl. Phys. Lett*. 87:173101.
Kim et al. (2009) "On Demand Electrohydrodynamic Jetting with Meniscus Control by a Piezoelectric Actuator for Ultra-Fine Patterns," *J. Micromech. Microeng*. 19:107001.
Kobayashi et al. (Jun. 1, 2000) "A Novel RGB Multicolor Light-Emitting Polymer Display," *Synthetic Metals* 111:125-128.
Kocabas et al. (2006) "Spatially Selective Guided Growth of High-Coverage Arrays and Random Networks of Single-Walled Carbon Nanotubes and their Integration into Electronic Devices," *JACS* 128:4540-4541.
Korkut et al. (Jan. 25, 2008) "Enhanced Stability of Electrohydrodynamic Jets Through Gas Ionization," *Phys. Rev. Lett*. 100(3):034503.
Kuoni et al. (2003) "A Modular High Density Multichannel Dispenser for Microarray Printing," 12th Int. Conf. on Solid State Sensors, Actuators and Microsystems (Boston, MA) 1:372-375.
Le, H. P. (1998) "Progress and Trends in Ink-Jet Printing Technology," *J. Imag. Sci. Technol*. 42:49-62.
Lee et al. (2007) "Electrohydrodynamic Printing of Silver Nanoparticles by Using Focused Nanocolloid Jet," *Appl. Phys. Lett*. 90:0819051-0819053.
Lee et al. (2008) Structuring of Conductive Silver Line by Electrohydrodynamic Jet Printing and Its Electrical Characterization, *J. Phys*. 142(1):012039.
Lee et al. (2005) "A Printable Form of Single-Crystalline Gallium Nitride for Flexible Optoelectronic Systems," *Small* 1:1164-1168.
Lemmo et al. (1998) "Inkjet Dispensing Technology: Application in Drug Discovery," *Curr. Opin. Biotechol*. 9:615-617.
Lenggoro et al. (Nov. 1, 2006) "Nanoparticle Assembly on Patterned 'Plus/Minus' Surfaces from Electrospray of Colloidal Dispersion," *J. Colloid Interface Sci*. 303(1):124-130.
Lewis et al. (2004) "Direct Writing in Three Dimensions," *Mater*. Today 7:32-39.
Li et al. (May 2006) "Aspirin Particle Formation by Electric-Field-Assisted Release of Droplets," *Chem. Eng. Sci*. 61:3091-3097.
Li et al. (Web Release Aug. 2, 2004) "Electrospinning of Nanofibers: Reinventing the Wheel," *Adv. Mater*. 16(14):1151-1170.
Ling et al. (2004) "Thin Film Deposition, Patterning, and Printing in Organic Thin Film Transistors," *Chem. Mater*. 16:4824-4840.
Liu et al. (Dec. 2005) "Low-Voltage All-Polymer Field Effect Transistor Fabricated Using an Inkjet Printing Technique," *Macromol. Rapid Commun*. 26(24):1955-1959.
MacDonald N C (Sep. 1996) "SCREAM MicroElectroMechanical Systems," *Microelectron. Eng*. 32:49-73.
Marginean et al. (Web Release Mar. 3, 2006) "Charge Reduction in Electrosprays: Slender Nanojets as Intermediates," *J. Phys. Chem. B* 110(12):6397-6404.
Marginean et al. (Aug. 9, 2006) "Order-Chaos-Order Transitions in Electrosprays: The Electrified Dripping Faucet," *Phys. Rev. Lett*. 97(6):064502.
Marginean et al. (2004) "Flexing the Electrified Meniscus: The Birth of a Jet in Electrosprays," *Anal. Chem*. 76:4202-4207.
McCarty et al. (Mar. 7, 2008) "Electrostatic Charging Due to Separation of Ions at Interfaces: Contact Electrification of Ionic Electrets," *Angew Chem. Int. Ed*.47(12):2188-2207.
Menard et al. (2004) "A Printable Form of Silicon for High Performance Thin Film Transistors on Plastic Substrates," *Appl. Phys. Lett*. 84(26):5398-5400.
Menard et al. (Apr. 2007) "Micro and Nanopatterning Techniques for Organic Electronic and Optoelectronic Systems," *Chem. Rev*. 107(4):1117-1160.
Mesquida et al. (Web Release Sep. 5, 2001) "Attaching Silica Nanoparticles from Suspension onto Surface Charge Patters Generated by a Conductive Atomic Force Microscope Tip," *Adv. Mater*. 13(18):1395-1398.
Mishra et al. (Aug. 2010) "High Speed Drop-on-Demand Printing with a Pulsed Electrohydrodynamic Jet." *J. Micromech. Microeng*. 20:095026:1-8.
Mishra et al. (2007) "Precision Positioning of Wafer Scanners: An Application of Segmented Iterative Learning Control," *Control Systems Magazine* 27(4):20-25.
Mishra et al. (2010) "Control of High-Resolution Electrohydrodynamic Jet Printing," *American Control Conference*, Baltimore, MD, Jun. 30, 2010-Jul. 2, 2010, pp. 6537-6542.
Mishra et al. (Apr. 2010) "A Desktop Electrohydrodynamic Jet Printing System with Integrated High-Resolution Sensing and Control," Presented at the 2010 ASPE Control Precision Systems Conference, Apr. 11-13, 2010, Cambridge MA.
Molesa et al.(2004) Technical Digest—International Electron Devices Meeting p. 1072-1074.
Moon et al. (Apr. 2002) "Ink-Jet Printing of Binders for Ceramic Components," *J. Am. Ceramic Soc*. 85(4):755-762.
Moore et al. (1988) "Learning Control for Robotics," In: Proceedings of 1988 International Conference on Communications and Control, Baton Rouge, Louisiana pp. 240-251.
Morris et al. (Sep. 18, 2000) "Microfabrication of a Metal Fuel Injector Nozzle Array," *Proc. SPIE* 4174:58-65.
Mukhopadhyay et al. (Apr. 4, 2007) "Exploiting Differential Etch Rates to Fabricate Large-Scale Nozzle Arrays with Protudent Geometry," *J. Micromech. Microeng*. 17(5):923-930.
Murata et al. (2005)."Super-fine ink-jet printing: toward the minimal manufacturing system" *Microsystem Technologies* 12:2-7.
Nallani et al. (2005) "Wafer Level Optoelectronic Device Packaging Using MEMS," *Proceedings of SPIE : Smart Sensors, Actuators, and MEMS II*, 5836, 116-127 (2005.
Nguyen et al. (Web Release May 1, 2009) "Mechanism of Electrohydrodynamic Printing Based on AC Voltage without a Nozzle Electrode," *AppL Phys. Lett*. 94(17):173509.
Okamoto et al. (2000) "Microarray Fabrication with Covalent Attachment of DNA Using Bubble Jet Technology," *Nat. Biotechnol*. 18:438-441.
Okazaki et al. (2004) "Microfactory—Concept, History, and Developments," *J. Manuf. Sci. Eng*. 126:837-844.
Olthuis et al. (1992) "On the Charge Storage and Decay Mechanism in Silicon Dioxide Electrets," *IEEE Trans Electr. Insul*. 27(4):691-697.
Pai et al. (1993) "Physics of Electrophotography," *Rev. Mod. Phys*. 65(1):163-211.

(56) References Cited

OTHER PUBLICATIONS

Parashkov et al. (2005) "Large Area Electronics Using Printing Method," *Proc. IEEE* 93:1321-1329.
Park et al. (2008) "Nanoscale Patterns of Oligonucleotides Formed by Electrohydrodynamic Jet Printing with Applications in Biosensing and Nanomaterials Assembly," *Nano Lett* 8(12):4210-4216.
Park et al. (2006) "In Situ Deposition and Patterning of Single Walled Carbon Nanotubes by Laminar Flow and Controlled Flocculation in Microfluidic Channels," *Angew. Chem. Int. Ed.* 45:581-585.
Park et al. (Web Release Jan. 12, 2010) "Nanoscale, Electrified Liquid Jets for High-Resolution Printing of Charge," *Nano Letters* 10:584-591.
Park et al. (Web Release Aug. 5, 2007) "High-Resolution Electrohydrodynamic Jet Printing," *Nature Materials* 6:782-789.
Park et al. (2007) "High Resolution Electrohydrodynamic Jet Printing for Printed Electronics," *Nano-CEMMS Industry Advisory Meeting*, University of Illinois at Urbana Champaign.
Paul et al. (2003) "Additive Jet Printing of Polymer Thin-Film Transistors," *Appl. Phys. Lett.* 83(10):2070-2072.
Payne et al. ( Web Release Apr. 10, 2004) "Robust, Soluble Pentacene Ethers," *Organic Letters* 6(10):1609-1612.
Pingree et al. (Web Release Dec. 4, 2009) "Electrical Scanning Probe Microscopy o Active Organic Electronic Devices," *Adv. Mater.* 21(1):19-28.
Preisler et al. (Web Release May 26, 2005) "Ultrathin Epitaxial Germanium on Crystalline Oxide Metal-Oxide-Semiconductor-Field-Effect Transistors," *Appl. Phys. Lett.* 86(22):223504.
Qin et al. (2003) "Adaptive Run-to-Run Control and Monitoring for a Rapid Thermal Processor," *J. Vacuum Sci. Technol. B Microelectronics Nanometer Struct.* 21(1):301-310.
Rayleigh L. (1879) "On the Capillary Phenomena of Jets," *Proc. R. Soc. Lond.* 29:71-97.
Redinger et al. (2004) "An Ink-Jet-Deposited Passive Component Process for RFID," *IEEE Trans. Electron Dev.* 51(12):1978-1973.
Ressier et al. (2008) "Electrostatic Nanopatterning of PMMA by AFM Charge Writing for Directed Nano-Assembly," *Nanotechnology* 19:135301.
Salata O. V. (2005) "Tools of Nanotechnology: Electrospray," *Curr. Nanosci.* 1:25-33.
Samarasinghe et al. (2006) "Printing Gold Nanoparticles with an Electrohydrodynamic Direct-Write Device," *Gold Bulletin* 39:48-53.
Sanaur et al. (2006) "Jet-Printed Electrodes and Semiconducting Oligomers for Elaboration of Organic Thin-Film Transistors," *Organic Electronics* 7:423-427.
Savill, D. (Jan. 1997) "Electrohydrodynamics: The Taylor-Melcher Leaky Dielectric Model," *Ann. Rev. Fluid Mech.* 29:27-64.
Scharnberg et al. (Web Release Jan 2, 2007) "Tuning the Threshold Voltage of Organic Field-Effect Transistors by an Electret Encapsulating Layer," *Appl. Phys. Lett.* 90:013501.
Schonenberger et al. (Feb. 15, 1992) "Charge Flow During Metal Insulator Contact," *Phys. Rev. B* 45(7):3861-3864.
Seemann et al. (Web Release Sep. 11, 2007) "Local Surface Changes Direct the Deposition of Carbon Nanotubes and Fullerenes into Nanoscale Patterns," *Nano Lett.* 7(10):3007-3012.
Sekitani et al. (Apr. 1, 2008) "Organic Transistors Manufactured Using Inkjet Technology with Subfemtoliter Accuracy," *Proc. Nat. Acad. Sci. USA* 105(13):4976-4980.
Sele et al. (2005) "Lithography-Free, Self-Aligned Inkjet Printing with Sub-Hundred Nanometer Resolution," *Adv. Mater.* 17:997-1001.
Shimoda et al. (2003) "Inkjet Printing of Light-Emitting Polymer Displays," *MRS Bulletin* 28:821-827.
Shimoda et al. (2006) "Solution-Processed Silicon Films and Transistors," *Nature* 440:783-786.
Shtein et al. (2004) "Direct Mask-Free Patterning of Molecular Organic Semiconductors Using Organic Vapor Jet Printing," *J. AppL Phys.* 96(8):4500-5407.
Sigmund P. (1987) "Mechanisms and Theory of Physical Sputtering by Particle Impact," *Nuc. Instrum. Methods Phys. Res.* 27:1-20.
Sirringhaus et al. (2000) "High-Resolution Inkjet Printing of All-Polymer Transistor Circuits," *Science* 290:2123-2126.
Smith et al. (2005) "Observation of Strong Direct-Like Oscillator Strength in the Photoluminescence of Si Nanoparticles," *Phys. Rev. B* 72:205307.
Smith et al. (Web Release Jul. 11, 2002) "Spreading Diagrams for the Optimization of Quill Pin Printed Microarray Density," *Langmuir* 18(16):6289-6293.
Smith et al. (1993) "Continuous Ink-Jet Print Head Utilizing Silicon Micromachined Nozzles," *Sensors Actuators A* 43:311-316.
Son et al. (2005) "Formation of Pb/63Sn Solder Bumps Using a Solder Droplet Jetting Method," *IEEE Trans. Electron. Packag. Manufact.* 28(3):274-281.
Stachewicz et al. (Web Release Jan. 21, 2009) "Relaxation Times in Single Event Electrospraying Controlled by Nozzle Front Surface Modification," *Langmuir* 25(4):2540-2549.
Stachewicz et al. (Web Release Dec. 3, 2009) "Stability Regime of Pulse Frequency for Single Event Electrospraying," *Appl. Phys. Lett.* 95(22):224105.
Sturm et al. (Jul. 1998) "Patterning Approaches and System Power Efficiency Considerations for Organic LED Displays," SPIE Conference on Organic Light-Emitting Materials and Devices II, San Diego, California *Proceedings of SPIE Volume*: 3476, p. 208-216.
Stutzmann et al. (2003) "Self-Aligned, Vertical Channel, Polymer Field Effect Transistors," *Science* 299:1881-1885.
Subramanian et al. (Dec. 2005) "Printed Organic Transistors for Ultra-Low-Cost RFID Applications," *IEEE Trans. Components Packag. Technol.* 28(4):742-747.
Sullivan et al. (2007) "Development of a Direct Three-Dimensional Biomicrofabrication Concept Based on Electrospraying a Custom Made Siloxane Sol," *Biomicrofluidics* 1:0341031-03410310.
Sun et al. (Web Release May 29, 2002) "Large-Scale Synthesis of Uniform Nanowires Through a Soft, Self-Seeding, Polyol Process," *Adv. Mater.* 14(11):833-837.
Sun et al. (Web Release Mar. 3, 2004) "Mechanistic Study on the Replacement Reaction Between Silver Nanostructures and Chloroauric Acid in Aqueous Medium," *J. Am. Chem. Soc.* 126(12):3892-3901.
Sun et al. (Dec. 5, 2006) "Controlled Buckling of Semiconductor Nanoribbons for Stretchable Electronics," *Nat. Nanotechnol.* 1:201-207.
Suryavanshi et al. (Web Release Feb. 21, 2006) "Probe-Based Electrochemical Fabrication of Freestanding Cu Nanowire Array," *Appl. Phys. Lett.* 88:083103.
Szczech et al. (2002) "Fine-Line Conductor Manufacturing Using Drop-On-Demand pzt Printing Technology," *IEEE Trans. Electron. Packaging Manufacturing* 25(1):26-33.
Tang et al. (Web Release Mar. 7, 2001) "Generation of Multiple Electrosprays Using Microfabricated Emitter Arrays for Improved Mass Spectrometric Sensitivity," *Anal. Chem.* 73(8):1658-1663.
Taylor G. (1969) "Electrically Driven jets," *Proc. Roy. Soc. Lond: Ser. A, Math Phys. Sci.* 313(1515):453-475.
Tseng et al. (2002) "A High-Resolution High-Frequency Monolithic Top-Shooting Microinjector Free of Satellite Drops—Part II: Fabrication, Implementation, and Characterization," *J. Microelectromechanical Syst.* 11(5):437-447.
Tseng et al. (2002) "A High-Resolution High-Frequency Monolithic Top-Shooting Microinjector Free of Satellite Drops—Part I: Concept, Design, and Model," *J. Microelectromechanical Syst.* 11(5):427-436.
Tzeng et al. (Web Release Apr. 24, 2006) "Templated Self-Assembly of Colloidal Nanoparticles Controlled by Electrostatic Nanopatterning on a $Si_3N_4/SiO_2/Si$ Electret," *Adv. Mater.* 18(9):1147-1151.
Uchiyama (1978) "Formulation of High-Speed Motion Pattern of a Mechanical Arm by Trial," *Trans. SICE* (*Soc. Instrum. Contr. Eng.*) 14 (6) (1978) 706-712 (in Japanese, English Abstract).
Volkman et al. (2003) Materials Research Society Symposium Proceedings; Warrendale, PA, p. 391.
Wang et al. (2006) "Solid Freeform Fabrication of Thin-Walled Ceramic Structures Using an Electrohydrodynamic Jet," *J Am Ceram Soc* 89(5):1727-1729.
Wang et al. (2006) "Low-Cost Fabrication of Submicron All Polymer Field Effect Transistors," *Appl. Phys. Lett.* 88:133502/1-133502/3.

(56) References Cited

OTHER PUBLICATIONS

Wang et al. (Web Release Apr. 25, 2005) "Polymeric Nanonozzle Array Fabricated by Sacrificial Template Imprinting," *Adv. Mater*. 17(9):1182-1186.
Wang et al. (Feb. 8, 2004) "Dewetting of Conducting Polymer Inkjet Droplets on Patterned Surfaces," *Nature Materials* 3:171-176.
Wang et al. (2009) "Fully Voltage-Controlled Electrohydrodynamic Jet Printing of Conductive Silver Tracks with a Sub 100 μm Linewidth," *J. Appl. Phys*. 106:0249071-0249074.
Wang et al. (2005) "High Resolution Print-Patterning of a Nano-Suspension," *J. Nanoparticle Res*. 7:301-306.
Wickware et al. (2001) "Mass Spectroscopy: Mix and Match," *Nature* 413:869.
Williams et al. (1996) "Etch Rates for Micromachining Processing," *J. Microelectromech. Syst*. 5(4):256-269.
Williams et al. (2003) "Etch Rates for Micromachining Processing-Part II," *J. Microelectromech. Syst*. 12(6):761-778.
Wong et al. (2003) "Hydrogenated Amorphous Silicon Thin-Film Transistor Arrays Fabricated by Digital Lithography," *IEEE Electron Dev. Lett*. 24:577-579.
Wong et al. (2002) "Amorphous Silicon Thin-Film Transistors and Arrays Fabricated by Jet Printing," *Appl. Phys. Lett*.80(4):610-612.
Youn et al. (2009) "Electrohydrodynamic Micropatterning of Silver Ink Using Near Field Electrohydrodynamic Jet Printing with Tilted-Outlet Nozzle," *Appl. Phys. A* 96:933-938.
Yuan et al. (Apr. 2003) "MEMS-Based Piezoelectric Array," *Micoelectron. Eng*. 66:767-772.

* cited by examiner

Fig. 1A
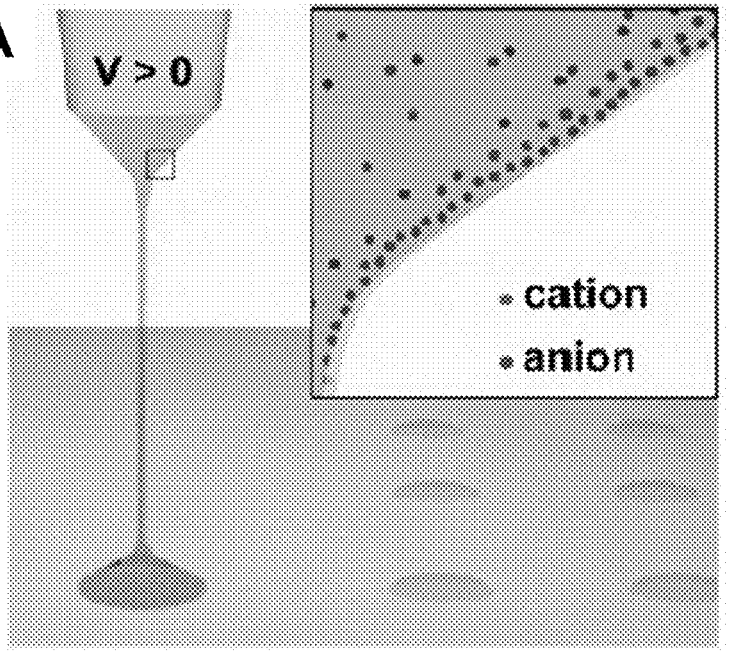
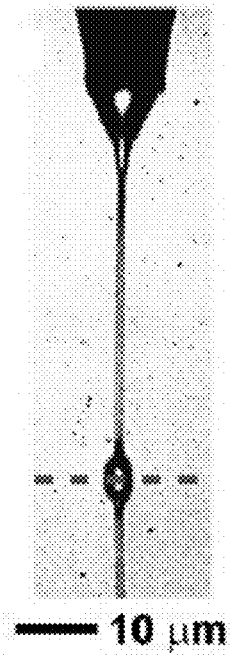
Fig. 1B
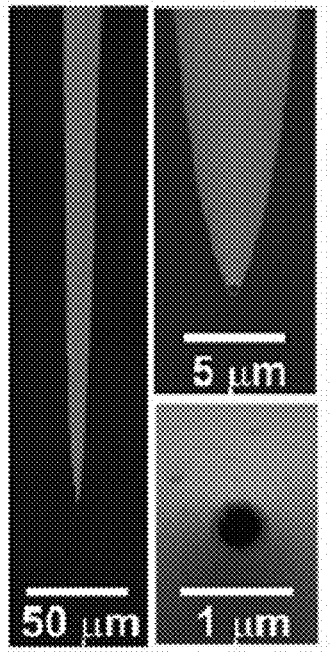
Fig. 1C

HIGH RESOLUTION PRINTING OF CHARGE

CROSS-REFERENCE TO RELATED APPLICATIONS

This application claims the benefit of priority under 35 U.S.C. 119(e) to U.S. provisional Patent Application 61/293,258 filed Jan. 8, 2010, which is hereby incorporated by reference in its entirety to the extent not inconsistent with the disclosure herein.

STATEMENT REGARDING FEDERALLY SPONSORED RESEARCH OR DEVELOPMENT

This invention was made with government support under DMI-0328162 awarded by the National Science Foundation and DE-ACO2-06CH11357 awarded by the U.S. Department of Energy. The government has certain rights in the invention.

REFERENCE TO A SEQUENCE LISTING

A sequence listing containing SEQ ID NO:1 is submitted herewith and is specifically incorporated by reference.

BACKGROUND OF INVENTION

Provided herein are methods and devices for printing of charge to a substrate surface, including by electrohydrodynamic jet (e-jet) printing, such as the e-jet systems and devices of PCT Pub. No. 2009/011709 (71-07WO). In particular, the performance and of e-jet systems for printing patterns of charge are improved by careful control of the process to avoid charge dissipation during the printing as well as after the charge is transferred to the substrate surface.

In conventional e-jet systems, effort is often directed to accurate and reliable liquid droplet placement of the printable fluid on the corresponding substrate surface. Accordingly, little or no attention is paid to printing of charge, and oftentimes the transfer of charge to the substrate is seen as undesirable in that charge build-up on the substrate can have undesirable effects on the printing of the fluid. Whereas previous systems have attempted to avoid or minimize the problem of charge transfer associated with e-jet printing, provided herein are methods to maximize charge transfer, including minimizing transfer of bulk fluid in which the charge is contained. The high resolution printing of charge processes provided herein are useful in a number of applications ranging from electronics, photovoltaics, document security and tracking, and in the biological or chemical sensing fields.

SUMMARY OF THE INVENTION

The methods disclosed herein provide a fundamental improvement in e-jet printing with respect to printing, placement, and preservation of charge on a substrate surface. In particular, the processes focus on various steps to ensure that charge in the printable fluid is both preserved during printing and retained after printing. This is a fundamentally different approach compared to conventional e-jet systems that focus on placement of bulk fluid on the substrate surface, but do not concern themselves with the printing of charge in and of itself. Various conditions are provided herein to maximize charge printing that can then be used in a wide range of applications, including for making functional devices.

In an embodiment, provided herein is a method of printing a pattern of charge on a substrate surface by providing a nozzle containing a printable fluid and a substrate having a substrate surface. An ejected printable fluid containing net charge is generated from the nozzle. The ejected printable fluid containing net charge is directed to the substrate surface, wherein the net charge does not substantially degrade and the net charge on the substrate surface is retained, thereby printing a pattern of charge on the substrate surface.

Retaining is used broadly to refer to charge maintenance on the substrate surface for a user-selected time period. Depending on the application of interest, this time period may be relatively long or relatively short (e.g., ranging from hours to more than many days). For example, in applications requiring long term charge retention, the retaining may further relate to an encapsulation step, where an insulating layer is deposited over the printed charge, thereby maximally retaining charge. Such an encapsulating or protecting layer is useful to protect the printed pattern of charge from ambient environment that contains free-charge that would otherwise dissipate printed charge. An encapsulation layer is particularly helpful in applications related to long-term retention of charge such as invisible security features, where authenticity is verified by confirming the appropriate pattern of charge remains on the substrate surface, such as by a charge reader that scans the substrate surface and compares the measured pattern against a key. In other embodiments, where the printed pattern charge is used more immediately (such as in subsequent manufacturing or processing steps), an encapsulation layer may be less relevant. In an aspect, the encapsulating layer is sufficiently thin so that the scanner is capable of detecting charge on the underlying substrate surface, but is also sufficiently thick to minimize the likelihood of charge leakage or undue damage to the encapsulating layer. In an aspect, the encapsulation layer has a thickness selected from a range that is greater than or equal to 10 μm and less than or equal to 1 mm. In an aspect, the encapsulation layer is optically clear, so that the underlying substrate remains visible and is not optically distorted. In an aspect, the substrate coated with charge is a commercial paper, including a negotiable instrument, currency, securities (e.g., stocks, bonds), or any other physical material having a surface susceptible to counter-fitting.

In an aspect, the method further relates to removing free-charge on the substrate surface, an ejected printable fluid region, or both, wherein the ejected printable fluid region corresponds to a region between the nozzle and the substrate surface. In an aspect, the region includes the substrate surface to which charge is printed, and the region adjacent thereto. Functionally, the region corresponds to any location where, if free charge were present, significant dissipation of net charge in the ejected printable fluid would occur. In an aspect, the free-charge has a polarity that is opposite to the net charge polarity, such as for negative printed charge positive free charge is removed and, similarly, for positive printed charge negative free charge is removed. Accordingly, for embodiments where positive and negative charges are printed, both positive and negative free charge is removed. In this aspect, the step of "removing" refers to decreasing the amount of free charge in the region that would otherwise act to dissipate the total net charge in the ejected printable fluid or net charge printed to the substrate, such as decreasing by at least 50%, at least 70%, at least 90% or at least about 99% to 100%. In an aspect, the decreasing can refer to control of the ambient environment, such as by reducing humidity, controlling atmospheric gases, or controlling temperature. In an aspect, the decreasing may relate to manipulation of the system, such as by introducing an insulating or coating layer, such as coating the nozzle, substrate, or other device components with an insulating material to avoid undesirable charge build-up and/or charge leakage or dissipation. In an aspect, corona discharge is avoided, such as by removing potentially ionizable material, including air or water vapor. In an aspect, the printing is in a pressure-controlled environment, such as an environment that is below room atmospheric pressure, or is at or near a vacuum.

In an embodiment, the charge printing occurs in a dry environment substantially free of counter-ions to the net charge. In an aspect, "dry environment" refers to water vapor level that is below normal room condition, such as water vapor that is less than or equal to 1 ppm, less than or equal to 0.5 ppm, or less than or equal to about 0.3 ppm.

In an aspect, the substrate surface comprises an insulating layer. In another aspect, free charge is removed from the substrate surface, including by surface treatment. For example, prior to printing the substrate may be treated with a material to reduce or dissipate substrate charge. In an aspect, selected substrate regions are treated, such as by coating with a hydrophobic material, as desired, and as dependent of the polarity of the printed charge on the selected substrate region.

In an aspect, the generating step comprises applying an electric potential difference between the nozzle and the substrate surface to establish an electrostatic force to the printable fluid in the nozzle, thereby controllably ejecting the printable fluid containing net charge from the nozzle onto the substrate surface. In an aspect, any of the e-jet devices, components, or processes described in PCT publication no. 2009/011709 and/or U.S. patent application Ser. No. 12/916,934 (filed Nov. 1, 2010; Atty Ref. 19-10), specifically incorporated by reference herein, are used in any of the methods disclosed herein.

In an embodiment, any of the methods described herein are further described in terms of maintenance of the printed pattern of charge on the substrate surface after printing. This can be described using a variety of functional descriptions. In an aspect, the maintenance of charge on substrate is characterized by lack of charge degradation over a user-selected time period, such as over the time period of days. In an aspect, the printed charge does not substantially degrade over a user-selected time period, wherein the time period is selected from a range that is up to eight days.

In an aspect, the ejected printable fluid comprises a droplet. In an aspect, the ejected printable fluid comprises a plurality of ejected droplets. In an aspect, the ejected printable fluid comprises a stream. In an aspect, a portion of the charge printing is a stream and another portion of the charge printing is a droplet. In this manner, net charge may vary as a function of substrate position (e.g., charge magnitude or charge polarity that varies with the xy-coordinate position on a substrate surface), such as by changing printing from a droplet mode to a stream mode.

In an embodiment, any of the methods provided herein are further described in terms of a printed charge parameter, such as peak printed potential. In an aspect, the printed pattern of charge has a peak printed potential between 50 mV and 15 V in a positive printing mode or a peak printed potential between −50 mV and −15 V in a negative printing mode. In an aspect, the printed charge parameter is further described in terms of the percentage degradation (or lack thereof) over a user-selected time period, such as maintaining peak printed charge within 80% of maximum over a defined time period.

In an aspect, the method further relates to repeating the printing to repeatedly print patterns of charge on the substrate surface. Such repeated or serial printing on a substrate surface provides additional pattern shape control as well as charge distribution. For example, a repeated printing step comprising overwriting a previously printed charge region with the same polarity charge provides capability to achieve high magnitude net charge printing, including peak printed potentials that cannot be readily or reliably achieved in a single printing step. Similarly, a repeated printing step comprising overwriting a previously printed charge region with an opposite charge, results in a local region on the substrate surface of reduced or no net charge. One embodiment of this aspect relates to overwriting to affect a dimension or geometry of a previously printed pattern. For example, the overwriting can reduce a printed pattern or feature dimension, thereby achieving much smaller dimensions than that obtained without overwriting. Alternatively, the overwriting can increase a dimension. Alternatively, the overwriting can reduce a first feature portion dimension, but increase a second feature portion dimension of the previously printed pattern of charge.

For example, a local region of reduced or no net charge can be described in terms of a geometric shape, and that geometric shape can be modified, or a dimension of that geometric shape modified. In an embodiment, the geometric shape is a line having a user-selected length and a width, and the overwriting reduces the width or length of the line of charge.

The methods provided herein are compatible with a wide range of printable fluids, including fluids comprising a charged material that is printed to the substrate. In an aspect, the printed charge comprises a charged material selected from the group consisting of ions, polymers, nanomaterials and biologic materials.

Examples of biological material include nucleic acid sequences (e.g., DNA, RNA), polypeptides, proteins, and fragments thereof. In aspects where the printing is for a bioassay device, the printed charge may directly relate to a charged biologic material, or to a charged material that facilitates subsequent binding of a biologic material of interest for the bioassay device (e.g., receptor molecule, antibody receptor, polynucleotide fragment). For example, functionalized microspheres or nanospheres, capable of binding to a charged substrate (e.g., the printed pattern of charge), and a receptor capable of binding to a to-be-detected chemical or biological material, may be used with any of the processes provided herein.

In an embodiment, the printed charge is suspended in a suspending fluid and after printing substantially no suspending fluid is transferred to the substrate surface. In an aspect, substantially all of the suspending fluid evaporates prior to physical contact with the substrate surface. In an aspect, the suspending fluid evaporates or is otherwise removed from the substrate after substrate contact, without substantially degrading the net charge transferred to the substrate surface.

In an aspect, the method relates to controlling the amount of charge printed to the substrate by controlling the size of a droplet (or stream flow-rate) of printable fluid ejected from the nozzle. Generally, the larger the droplet, the higher the net charge. In an aspect, the droplet is part of a fluid stream, and charge is controlled by increasing the flow-stream of printable fluid from the nozzle tip, such as to increase the net charge deposited on the substrate surface, or decreasing the fluid flow-stream to decrease the amount of net charge deposited on the substrate, or a combination thereof.

The printing methods provided herein are versatile with respect to the polarity of printed charge in that the method is operational in terms of a positive printing mode (PPM), negative printing mode (NPM), or both PPM and NPM. In an aspect, the method further relates to reversing the net charge polarity during printing, thereby printing a pattern of charge comprising positive charge regions and negative charge regions. Such a dual-mode printing can provide additional advantages. For example, in an aspect where the printed charge pattern provides guided deposition of another material (such as by electrostatic binding of a material of opposite polarity), printed charge regions of the same polarity to the material that is to be controllably patterned on the substrate surface can further assist in guiding the deposition pattern of the material, thereby further increasing resolution and placement accuracy of the material.

In an embodiment, the printed pattern of charge comprises a feature, wherein the feature has a characteristic dimension that is less than or equal to 10 μm. For example, the printed charge may correspond to a charged material in the fluid, such as a micrometer-scale (e.g., between 1 μm and 1 mm) or a nanometer-scale (e.g., between 1 nm and 1 μm) which is inherently charged, contains charge, and/or is processed to have a charged-coating or charged surface. Similarly, printing of charged polymers provides printed features that are charged. Accordingly, the printed pattern of charge may be further characterized as a printed pattern of features, where the features are charged and further characterized or described by feature size.

In an aspect, the printed pattern of charge comprises a plurality of dots of charge, such as for the embodiment where a plurality of droplets containing net charge are ejected from the nozzle. In an embodiment, the plurality of dots of charge form nanolines of charge on the substrate having a width less than 100 nm and a length greater than or equal to 1 μm.

In an embodiment, any of the methods provided herein relate to the printed charge maintaining a peak printed potential that is within 80% of initial peak printed potential for a post-printing time period selected from a range that is greater than or equal to 7 days, such as between 7 days and 21 days.

In an embodiment, any of the methods provided herein relate to a printed pattern of charge having a charge polarity that is negative, positive, or both negative and positive charge.

In an aspect, any of the methods of printing charge are used to guide subsequent deposition of a material. In an embodiment, the method further comprises depositing a pattern of material on the substrate surface having the pattern of charge, wherein the deposited material pattern corresponds to the printed pattern of charge. For example, a printed pattern of negative charge can guide subsequent deposition of a material having positive charge, so that the deposited material has a pattern corresponding to the original printed pattern of negative charge. Similarly, a material having a negative charge can be deposited in a pattern corresponding to the printed pattern of positive charge. In an aspect, the material is deposited on the entire substrate, and then processed so that material that is not electrostatically bound to the charge pattern on the underlying substrate is removed. In an embodiment, the processing is by a rinse of the substrate surface, wherein hydrodynamic force on the material is greater than the non-specific binding energy between the material and the substrate, but is less than the electrostatic force between the material and the oppositely charged pattern beneath the material, so that the only remaining material is that overlying the charged pattern to which the material is bound via electrostatic interaction.

In an aspect, the printed pattern of charge affects a physical parameter of the underlying substrate surface. In an embodiment, the physical parameter is binding affinity to a material; electrostatic attraction or repulsion; or electronic or optoelectronic property. For example, the printed pattern of charge can effectively result in binding of a material that would otherwise not bind to the substrate.

In an embodiment, the printed pattern of charge is used to provide electrostatic control of an electronic, optoelectronic, photovoltaic or mechanical device.

In another embodiment, the invention relates to a functional device, such as a functional device made by any of the processes provided herein. In an aspect of this embodiment, the functional device is selected from the group consisting of an electronic component; a bioassay device; an anti-counterfitting device; an optoelectronic device, a photovoltaic device, a mechanical device; and a security feature.

In an embodiment, provided herein is a method of processing a substrate surface by charge deposition by providing a nozzle containing a printable fluid and a substrate having a substrate surface and, generating from the nozzle an ejected printable fluid containing net charge. The ejected printable fluid containing net charge is directed to the substrate surface, wherein the net charge does not substantially degrade. The net charge on the substrate surface is retained and the printed charge influences a physical parameter of the substrate surface underlying the printed charge.

In an aspect, any of the methods or devices relate to a substrate to which the charge is printed that comprises silicon.

In an aspect, the physical parameter affected by the printed charge is selected from the group consisting of binding affinity; an electronic or optoelectronic property; electrostatic attraction or repulsion.

In an embodiment, any one or more of the sensing and control systems provided in U.S. patent application Ser. No. 12/916,934 (filed Nov. 1, 2010; Atty ref. 19-10), which is specifically incorporated by reference herein, is used with any of the charge printing disclosed herein.

In another embodiment, any one or more of the sensing and control systems provided in U.S. patent application Ser. No. 12/916,934 (filed Nov. 1, 2010; Atty ref. 19-10), specifically incorporated by reference, is used with any of the charge printing provided, such as to achieve even higher resolution charge printing, accuracy and control.

Without wishing to be bound by any particular theory, there can be discussion herein of beliefs or understandings of underlying principles or mechanisms relating to embodiments of the invention. It is recognized that regardless of the ultimate correctness of any explanation or hypothesis, an embodiment of the invention can nonetheless be operative and useful.

BRIEF DESCRIPTION OF THE DRAWINGS

FIG. 1A-1F. High-resolution printing of charge by controlled use of electrohydrodynamic jets (e-jets). A Schematic illustration of field-induced charge accumulation near the meniscus at the tip of a fine nozzle. B Cone-jet transition captured using a high-speed camera. The image reflected from a substrate (dashed horizontal line) is also shown. C SEM images (side and tip view) of a nozzle with 300 nm internal diameter (i.d.). D KFM potential image (left) and the 3D image (right) that includes height information. E KFM height (top) and potential (bottom) mode images of the patterns printed using the 300 nm i.d. nozzle at PPM (left) and NPM (right). Here, the dot diameters are ~300-400 nm in the height mode. F KFM images of the charged dots printed using a spray mode. A printed dot is indicated with an arrow to show the limit of our KFM potential measurement, as an example.

DETAILED DESCRIPTION OF THE INVENTION

Figure 1D:
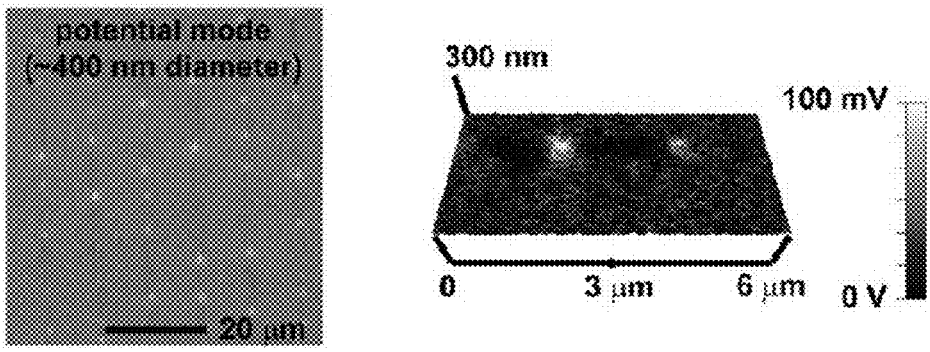

"Pattern of charge" refers to the distribution of charge over a substrate surface. The processes disclosed herein provide a wide versatility in that any arbitrary pattern of charge can be generated on a substrate surface. In an aspect, the pattern of charge includes both positive and negative charge regions. In an aspect, the pattern of charge relates to a pattern of a single polarity of charge (either positive charge or negative charge). In an aspect, the printed charge density varies, so that peak printed potential spatially varies. In an aspect, the pattern comprises a patterned network or circuit of charge, such as a plurality of straight or curved lines, interconnected as desired. In an aspect, the process generates regions of charge over a selected surface area having any desired shape, such as lines, rectangles, circles, squares, triangles, ellipses, or other shape depending on the desired end applications.

"Printable fluid" is used broadly to refer to a material that is compatible with the e-jet process and, in particular, is ejected from the printing nozzle under suitable conditions. The ejected printable fluid carries or contains net charge that is to be printed on a surface. The printable fluid may be charged or may be overall charge-neutral, with a balance of positively-charged and negatively-charged materials, including cations and anions, providing overall charge balance. The printable fluid may contain a charged material. Irrespective of the particular printable fluid composition, the e-jet process results in printable fluid ejected from a print nozzle that has net charge (positive or negative). Different types of printable fluids or "ink" may be used, including liquid ink, hot-melt ink, ink comprising a suspension of a material in a volatile fluid. The ink may be an organic ink or an inorganic ink. An organic ink includes, for example, biological material suspended in a fluid, such as DNA, RNA, protein, peptides or fragments thereof, antibodies, and cells, or non-biological material such as carbon nanotube suspensions, conducting carbon (see, e.g., SPI Supplies® Conductive Carbon Paint, Structure Probe, Inc., West Chester, Pa.), or conducting polymers such as PEDOT/PSS. Inorganic ink, in contrast, refers to ink containing suspensions of inorganic materials such as fine particulates comprising metals, plastics, or adhesives, or solution suspensions of micro or nanoscale solid objects. The printable fluid may comprise a nanomaterial, such as metallic nanoparticles that are charged. A "functional ink" refers to an ink that when printed provides functionality to the surface. Functionality is used broadly herein and refers to an ink that is compatible with any one or more of a wide range of applications including surface activation, surface inactivation, surface properties such as electrical conductivity or insulation, surface masking, surface etching, electrostatic binding affinity, etc. For ink having a volatile fluid component, the volatile fluid assists in conveying material suspended in the fluid to the substrate surface, but the volatile fluid evaporates during flight from the nozzle to the substrate surface or soon thereafter, leaving substantially only charge with minimal transfer of bulk fluid.

"Ejected printable fluid" refers to printable fluid that is forcibly ejected from the nozzle during the e-jet process. "Net charge" refers to the charge of the ejected printable fluid and reflects the ejected fluid, although having overall charge, may comprise positively and negatively charged material.

"Directing" refers to controlled placement of charge, from the printable fluid in the nozzle to the substrate surface that is positioned in an opposed configuration relative the nozzle orifice from which the printable fluid is ejected.

"Substantially degrade" refers to net charge in the ejected fluid that does not significantly dissipate, such as to the surrounding environment. In an aspect, this refers to the majority of charge (e.g., greater than 50%) being preserved. In other aspects, substantially degrade refers to at least 70%, at least 80%, at least 90%, or about all of the net charge in the ejected fluid being preserved. Similarly, "retaining" refers to the charge that is printed on the substrate surface being preserved, and reflects that in certain aspects some net charge may be dissipated after fluid ejection (but before substrate contact) and some of the net charge may be dissipated after contact with the substrate. In an aspect, retaining refers to the majority of charge (e.g., greater than 50%) being preserved relative to the charge that is initially deposited to the surface. In other aspects, retaining refers to at least 70%, at least 80%, at least 90%, or about all of the net charge of the printed charge being preserved.

"Ejected printable fluid region" refers to the region between the nozzle tip and the substrate surface, and region immediately adjacent thereto, wherein the presence of free charge would significantly impact net charge in the ejected printable fluid. In an aspect, the ejected printable fluid region corresponds to the space occupied by the ejected printable fluid as it travels from the nozzle tip to the substrate surface, and a boundary region adjacent thereto, such as a boundary that is at least about 1 cm, about 1 mm or about 100 μm in width around the ejected fluid. In an embodiment, the entire region above the substrate surface to which charge is to be printed is considered the ejected printable fluid region where free-charge removal occurs, thereby ensuring net charge does not substantially degrade.

"Stream" refers to continuously ejected printable fluid. Alternatively, the stream may be cut-off, thereby generating droplets of ejected printable fluid. Printing may be changed between droplet and stream modes by varying one or more parameters that affect printing, including potential differences, off-set height between the nozzle and substrate surface and/or printable fluid composition. In an aspect, the substrate and nozzle orifice move relative to one another, so that a lines of charge is printed, with printing multiple adjacent charged lines providing the capability of printing complex charge patterns (beyond dots and lines).

"Peak printed potential" refers to the maximum potential on a pattern of charge. In particular, a pattern may not only refers to the polarity of charge pattern (e.g., locations with positive potential, negative potential, and zero potential), but may also refer to the magnitude of charge.

"Nanomaterial" refers to any material having at least one dimension that is on the order of nanometers (e.g., less than 1 μm), such as a nanoparticle, nanowire or other shaped object as desired. In an aspect, the nanomaterial is a material that is made to be charged, such as by surface functionalization to which charge is attached, or may inherently be charged, such as a charged metal.

In the aspect where substantially is used to describe transfer of suspending fluid to the substrate, "substantially" refers to at least 50% of the fluid in which the charged particles reside, evaporates. In other aspects, "substantially" refers to at least 70%, at least 90%, or all the suspending fluid in which the printed charge is suspended evaporating or otherwise not being transferred to the substrate surface.

"Feature" refers to a physical shape that is printed to the substrate surface, and in which charge is embedded and/or attached thereto. Accordingly, the feature may be charged relief feature such as a feature having a shape (e.g., depth, cross-sectional shape including circle, square, rectangles (e.g., walls)). "Characteristic dimension" refers to a feature dimension that provides a description of physical size. For example, for a tapered dimension, the characteristic dimension may be an average value. For other objects, the characteristic dimension may be a width, length, height, diameter, or diameter of a corresponding spherical object having a volume equivalent to the feature.

"Functional device" refers to a device, or component thereof, that is of beneficial use in an application. For example, a component in an electronic circuit is considered a functional device. One particular example of such a component is a transistor in that the charge pattern on a material can provide useful control of various electronic properties of a transistor. Other electronic components may be made in part (e.g., semiconductor materials) using the processes provided herein, wherein an electrical property of the material is controlled, including conductivity, resistivity, impedance. Similarly, charge printing may be used to control an optical property, including transmission or reflectance. Similarly, charge printing may be used to deposit biologic material in a specific pattern so that a bioassay device, to provide functional readout of any number of biologic analytes (or indicators thereof). Examples of useful bioassay devices that rely in part on, the layout of a charged biological material include lateral flow-assays, chips such as DNA, RNA or protein chips, and other assays that detect a presence or absence of a biological material. Another category of functional devices includes anti-counter-fitting device, where an object susceptible to counter-fitting is coated with a charged pattern that is subsequently used to either track/trace the object and/or confirm that the object is authentic. Not only is this useful in the commercial paper context, but can include packaging, such as packaging of pharmaceuticals, or labels affixed to goods, including brand labels.

Nanoscale, Electrified Liquid Jets for High-Resolution Printing of Charge: Nearly all research in micro- and nanofabrication focuses on the formation of solid structures of materials that perform some mechanical, electrical, optical, or related function. Fabricating patterns of charges, by contrast, is a much less well explored area that is of separate and growing interesting because the associated electric fields can be exploited to control the behavior of nanoscale electronic and mechanical devices, guide the assembly of nanomaterials, or modulate the properties of biological systems. This example describes a versatile technique that uses fine, electrified liquid jets formed by electrohydrodynamics at micro- and nanoscale nozzles to print complex patterns of both positive and negative charges, with resolution that can extend into the submicrometer and nanometer regime. The reported results establish the basic aspects of this process and demonstrate the capabilities through printed patterns with diverse geometries and charge configurations in a variety of liquid inks, including suspensions of nanoparticles and nanowires. The use of printed charge to control the properties of silicon nanomembrane transistors provides an application example.

The most widespread use of charge patterning is in xerography[1,2] where a corona creates uniform electrostatic charge on the surface of a photoconductor; patterned exposure of light then leads to local charge dissipation in desired geometries. The resulting pattern of charge guides the assembly of toner particles (with opposite charge) that are subsequently sintered to form a permanent image. Recently, more research-oriented techniques have been developed to allow considerably higher resolution and finer control over charge, by use of conducting tips in the form of either atomic force microscope (AFM) probes[3-8] or metal-coated elastomeric stamps[9-11] both in contact printing schemes. The process involves injection of electrons into materials such as poly(methyl methacrylate) and $SiO_2$ that can store this charge for extended periods (i.e., via formation of electrets). In these existing techniques, specialized materials for the photoconductors and electrets[9,12,13] are required, thereby limiting their broader utility. Methods provided herein relate to a much different approach that involves the direct printing of charge, including ions, from fine nozzle tips in the form of electrified liquid jets or printed droplets with nanoscale dimensions. Positive and negative patterns of ionic charge, with nanoscale resolution and in nearly arbitrary configurations, can be formed in this manner.

The experimental setups rely on adapted versions of electrohydrodynamic jet (e-jet) printers[14-16] that are recently reported as high-resolution alternatives to conventional thermal and piezoelectric inkjet systems (see, e.g., PCT Pub. No. 2009/011709 (Atty Ref. 71-07WO)). Such technology enables printing of liquid inks with resolution approaching ~100 nm for applications in DNA microarrays, printed transistors, biosensors, and fine electrode structures.[14-17] In these systems, ink delivered from a reservoir to the tip of a fine, metal-coated nozzle forms a pendent hemispherical meniscus. A dc voltage bias applied between the nozzle and the substrate leads to the accumulation of mobile charges in the ink near the surface of the meniscus, as illustrated in FIG. 1A. Positive (negative) charges predominate with positive (negative) voltages at the nozzle relative to those at the substrate. Coulombic repulsion between these charges induces electrostatic stresses that deform the meniscus into a conical shape (Taylor cone).[18] With increasing applied voltage, the sum of this electrostatic force and the externally applied pressure eventually exceeds the force associated with the capillary pressure at the apex of the cone, leading to the formation of a thin liquid jet that emerges from the tip of the Taylor cone and ejects toward the substrate.[19-22] (A constant, externally applied pressure (e.g., pneumatic) can assist the electric-field-induced liquid flow.[16]) FIG. 1B shows an image of a representative conical meniscus, a liquid jet, and printed droplet, captured using a high-speed camera (Phantom v7.0, Vision Research). After ejection, the jet retracts back to the nozzle, to recover the original meniscus shape.[14,23] A key, previously unexploited feature of this process is that the printed droplets contain overall net charge. Here we demonstrate that this physics can be exploited to yield a "charge printer" capable of forming complex patterns of positive or negative (or both) charge, including ionic charge, with resolution extending into the nanoscale regime, with very little or controlled amounts of material transfer, on nearly any surface. Relevant applications of the charge printing process range from invisible, printed security codes to means for electrostatic control of nanoelectronic/mechanical devices to guided assembly of charged particles or micro/nanostructures to modulation of activity in biological systems.

In the following, we describe the fundamental aspects and the technical capabilities, with an application example in the controlled, patterned electrostatic doping of silicon nanomembrane transistors.

As an example, FIG. 1C-1D show a scanning electron microscope (SEM) image of a nozzle tip with a 300 nm i.d. and dots of charge (~400 nm diameters) printed with such a nozzle, respectively. Here, the ink consisted of a photocurable polyurethane (NOA 74, Norland) and the substrate was $SiO_2$ (100 nm)/Si treated with hexamethyldisilazane (HMDS). The left frames of FIG. 1E correspond to jetting with a positive voltage at the nozzle and a grounded substrate, referred to in the following as the positive printing mode (PPM). Kelvin force microscopy (KFM; height and potential modes, Asylum research MFP-3D AFM) reveals that the printed dots have positive potentials (dot diameter, ~300 nm in height modes; charge width, ~2.5 μm in potential mode) as expected from the physics of the process outlined in the previous paragraph. Here, the peak potentials are ca. +1 V, at the position of the thickest regions (~15 nm) of the printed dots. Reversing the bias yields nearly identical printing resolution, but with opposite charge (right of FIG. 1E). We refer to this operation as negative printing mode (NPM). Although the ultimate limits in resolution are difficult to precisely define, we suspect that they extend to the range of tens of nanometers and below. As evidence, FIG. 1F shows printed droplets and charge formed at the periphery of an area patterned in a high-voltage operating mode designed to produce some spray. Here, the feature sizes (i.e., 40-80 nm of dot diameters in the height mode) approach the limits associated with our KFM measurement.

Figure 2A:
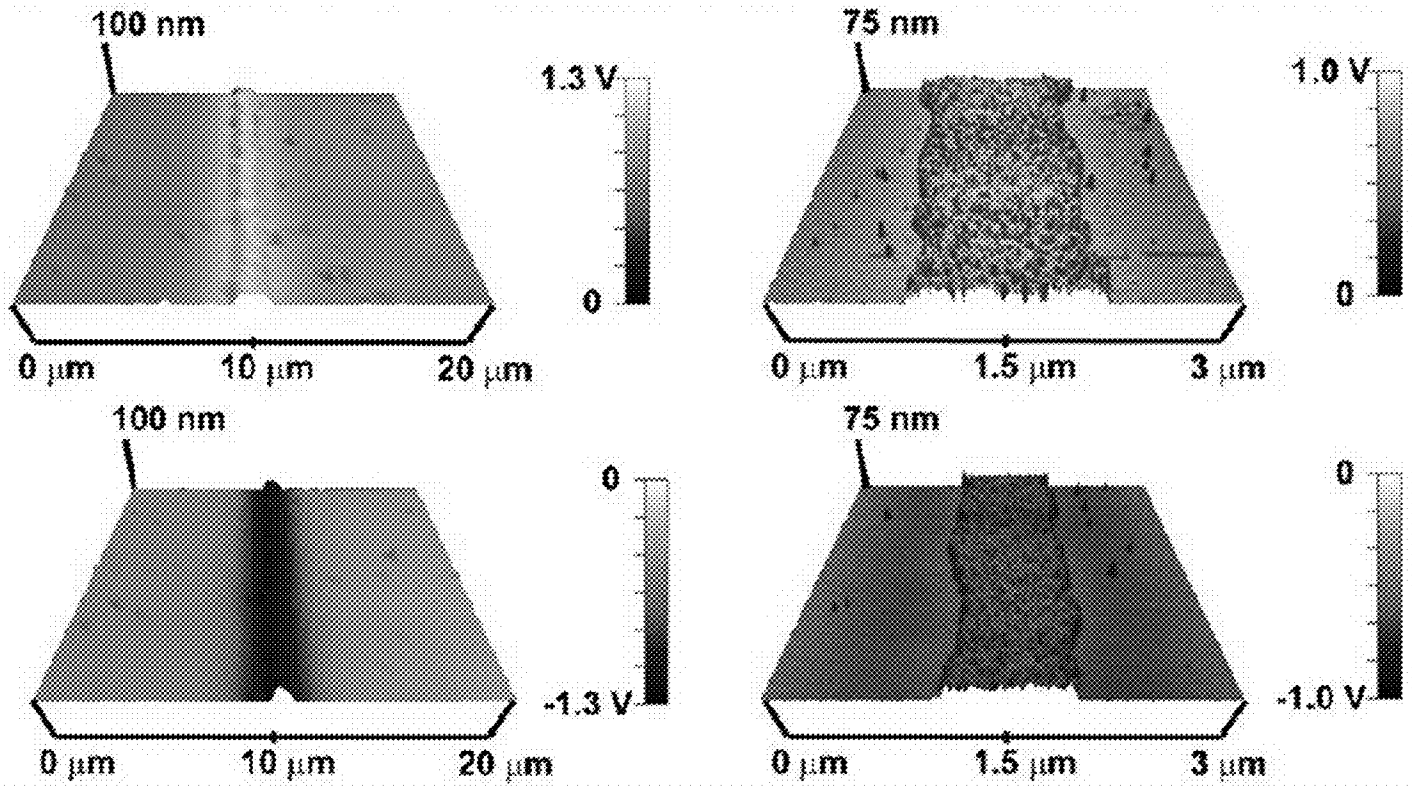
FIG. 2A-2D. Charge printing using various inks, including nanomaterials, in simple and complex geometries. 3D KFM images of the samples printed using suspensions of A Ag nanoparticles, B Ag nanowires, and C Ag nanocubes at PPM (top) and NPM (bottom). Right images in A show magnified areas. D Optical micrograph of a complex pattern (Michelangelo's piéta) of charge printed by e-jet using a polyurethane ink (left), with high-resolution images of height (AFM; top) and potential (KFM; bottom) corresponding to the box on the left image. The peak thicknesses and potentials associated with the dots in these images are ~150 nm and ~0.25 V, respectively.
Figure 2B:
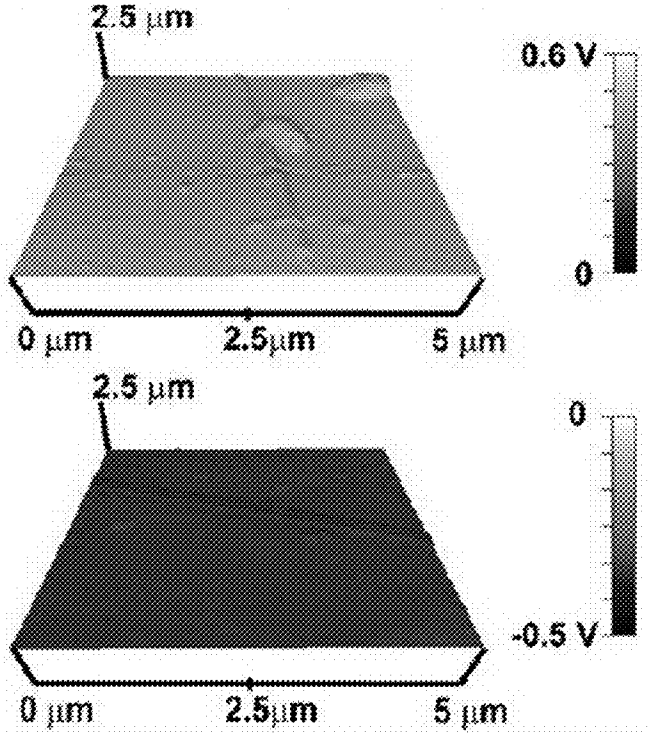
Figure 2C:
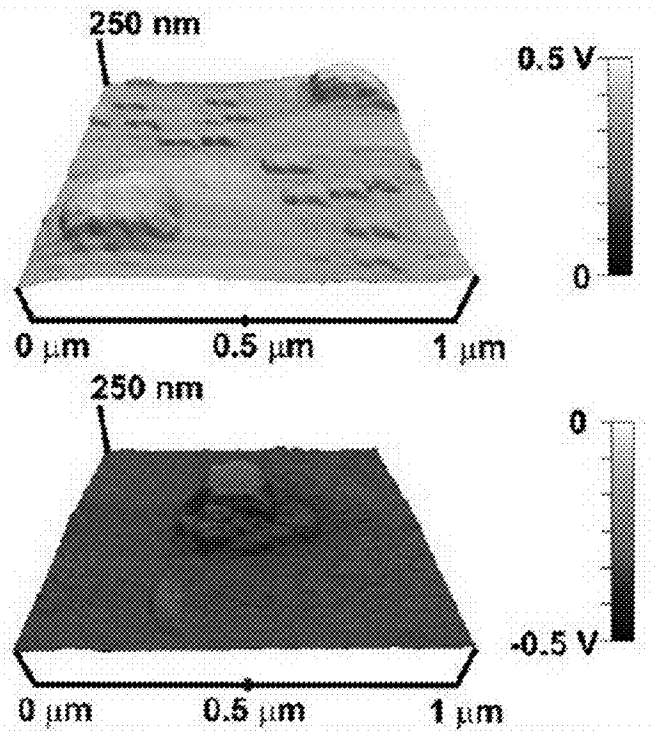
Figure 2D:
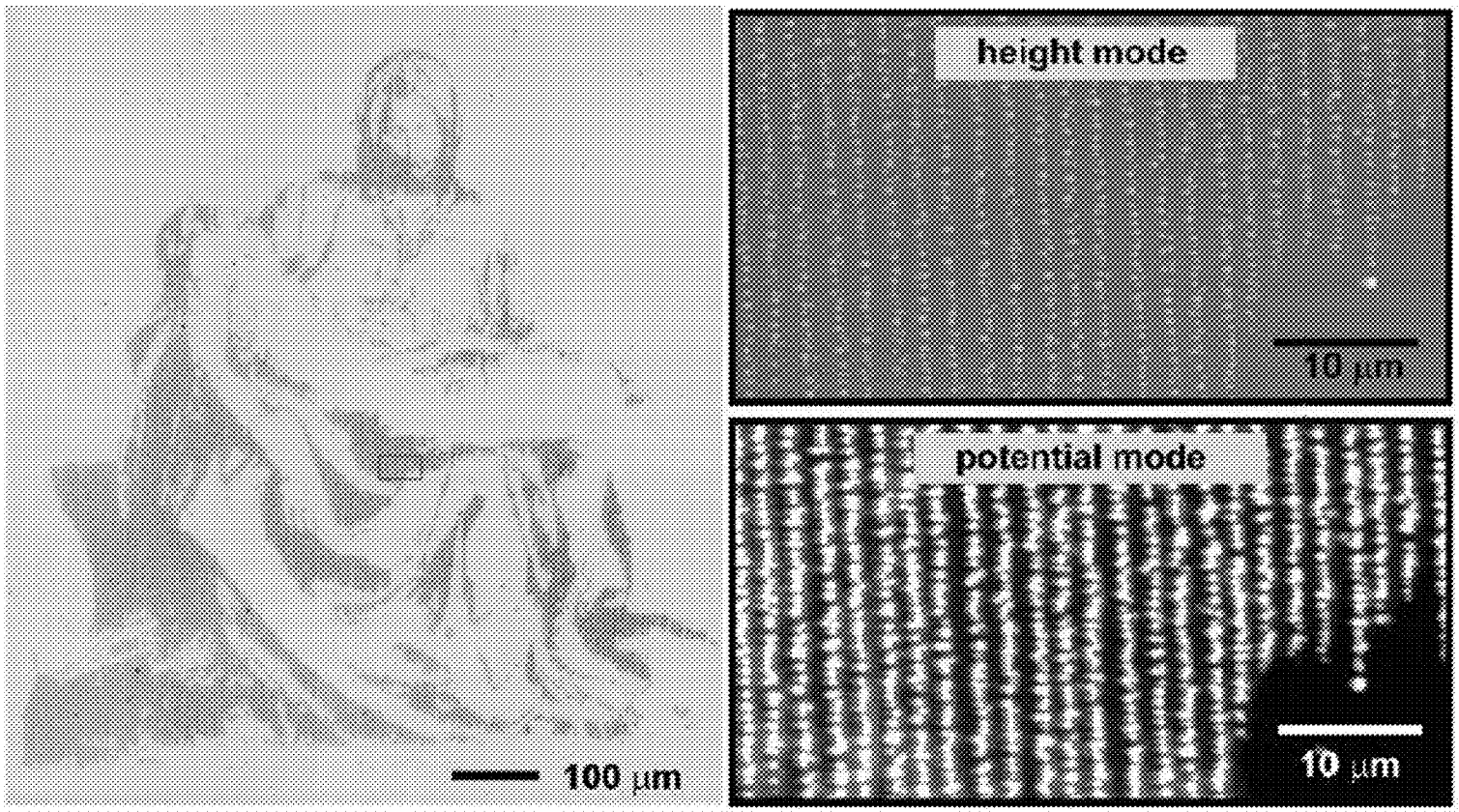
Figure 6A:
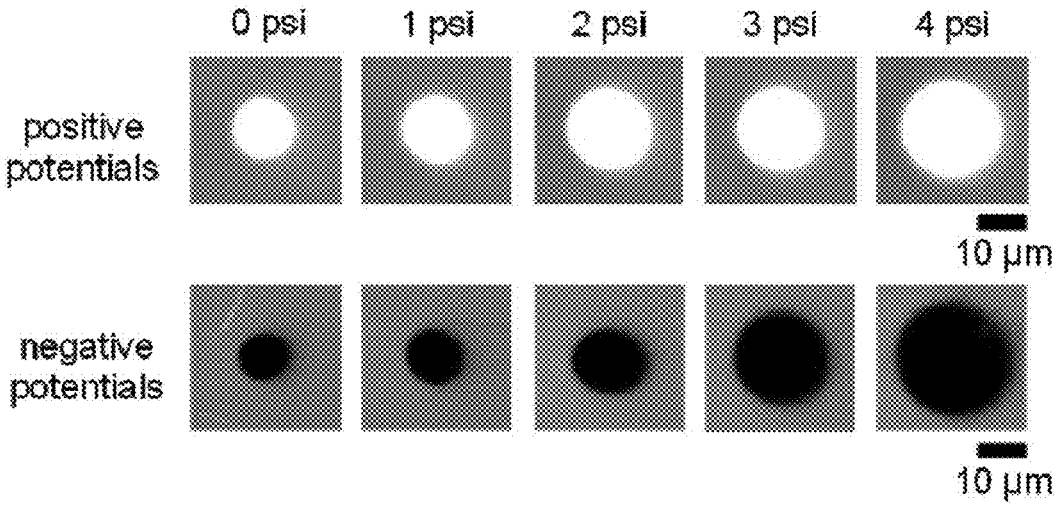
FIG. 6A-6B. A KFM potential mode images of dots printed using a 2 μm ID nozzle with the applied air pressures of 0~4 psi. Aqueous NaCl suspension (1 mM, 30% glycerin) is used as an ink. B Relationship between the applied air pressure and overall potentials [$\pi\times(FWHM/2)^2\times$potential at FWHM]. The overall potentials of the dots printed at different air pressures are divided with the value at 0 psi for comparison. Bigger droplets generated using higher air pressures lead to larger overall potentials.
Figure 6B:
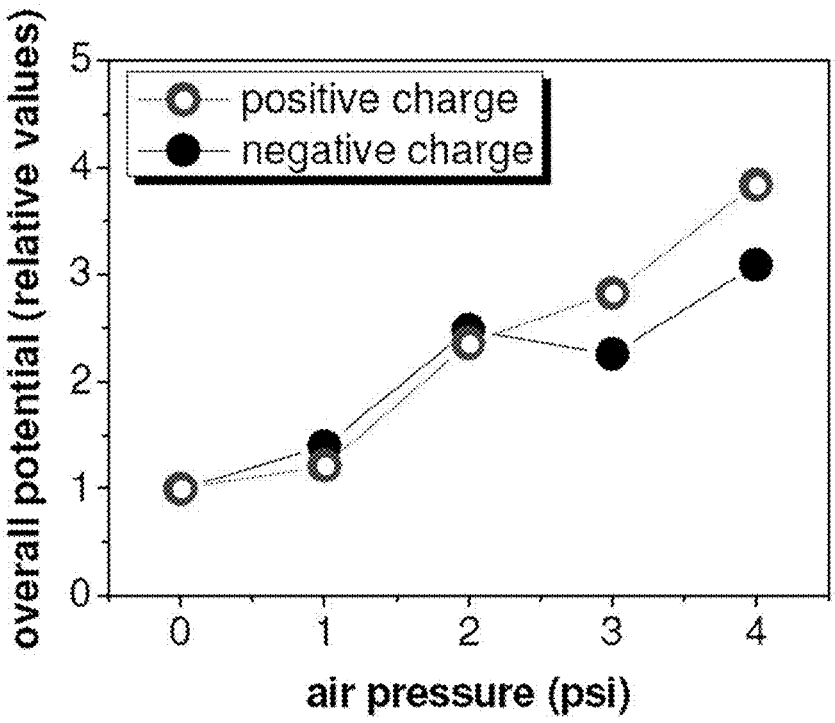

In addition to nanoscale features, these methods are well suited to the patterned deposition of nanomaterials (having any of a variety of geometric shapes) with controlled charge. FIG. 2A shows examples of the silver nanoparticles (2-5 nm diameter) with a proprietary organic functional group for dispersion in tetradecane (Harima Chemicals, NPS-J-HP). Lines are printed using the ink with PPM (top) and NPM (bottom); the peak potentials are ca. ±0.5 V with ~10 nm heights (nozzle, 1 μm i.d.). FIG. 2B-2C represent the potential images of patterns printed using suspensions of silver nanowires[24] and nanocubes[35] (50 wt % of dimethylformamide added for nanowires and nanocubes) with 5 μm i.d. nozzles. Here, the nanowires (diameter, ~60 nm; length, ~10 μm) and nanocubes (edge length, ~120 nm) are printed with organic residues; the peak potentials of the dots are ca. ±0.3 and ±0.7 V, respectively. Use of these or other inks with automated e-jet printer systems allows formation of user-definable charge patterns. FIG. 2D provides KFM analysis of an image of Michelangelo's piéta statue formed in PPM with a 500 nm i.d. nozzle and polymer (polyurethane) ink. The total size of the image is ~800×820 μm, as shown in the left side of FIG. 2D. The physical heights (top panel) (peak values ~150 nm) of the dots in the dashed area of the left panel and their electrical potentials (bottom panel) (peak values ~0.25 V) appear in the right side of FIG. 2D. We note that for these inks, and in certain other cases that follow, we did not add ionic components. Residual concentrations of ions are apparently sufficient. The breakup of a droplet occurs when the electrostatic repulsion exceeds the surface tension.[25] The maximum amount of charge per droplet is therefore limited, and dependent on the droplet size as well as surface tension of the liquid-air interface (Rayleigh limit).[25-27] In e-jet, the characteristic droplet size can be changed by changing the nozzle diameter or the applied air pressure,[16,23] thereby providing also a means to control the charge printed in each drop. To demonstrate this effect, we print dots with different diameters and then determine their potentials with KFM. As shown in FIG. 6A-6B, bigger droplets printed with higher air pressures lead to larger potentials.

Figure 1E:
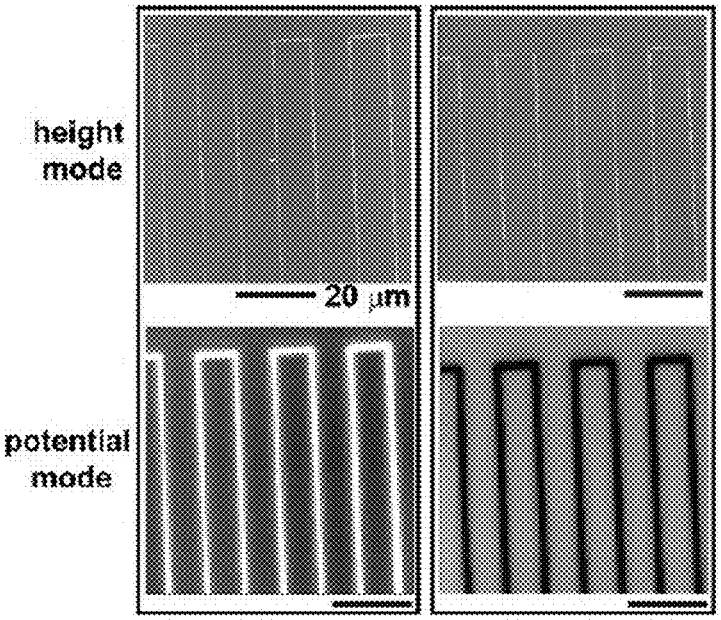
Figure 1F:
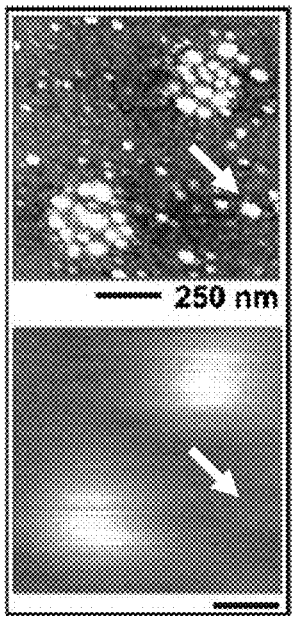
Figure 3A:
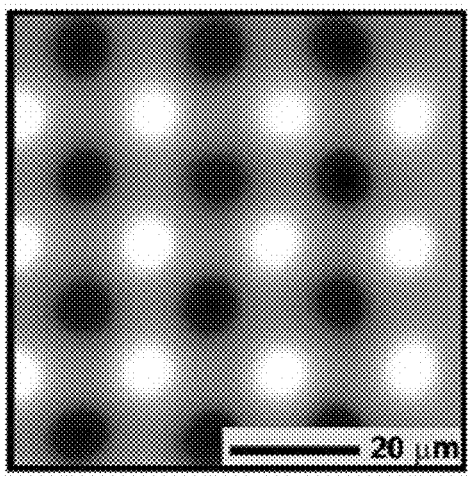
FIG. 3A-3G. Printing and dissipation of positive and negative charges controlled by electric field direction. A Potential mode KFM images of aqueous sodium phosphate solution (10 mM, pH~7). B Polyurethane (pH~5). C Quinoline (pH>8). D Aqueous DNA suspension. E Potential control by printing multiple times with an ink of (poly(ethylene glycol) diacrylate). F KFM potential images of an ink of NaCl in water (30% glycerin added), printed on a 100 nm thick $SiO_2$ surface (on a Si wafer) in ambient air with a 2 μm i.d. nozzle, at various times after printing. The graph on the right shows the change in characteristic widths (W) and peak potentials (V), normalized to the values immediately after printing ($W_o$, $V_o$), for the positive case. The negative case shows similar behavior. The filled and vacant squares (or circles) in the graphs indicate the normalized potential ($V/V_o$) and fwhm ($W/W_o$) for the hydrophilic (or hydrophobic) surfaces, respectively. G KFM potential images of the NaCl ink printed stored in low humidity ($H_2O$~0.3 ppm). The graph on the right provides information similar to that of the graph in the frame above.
Figure 3B:
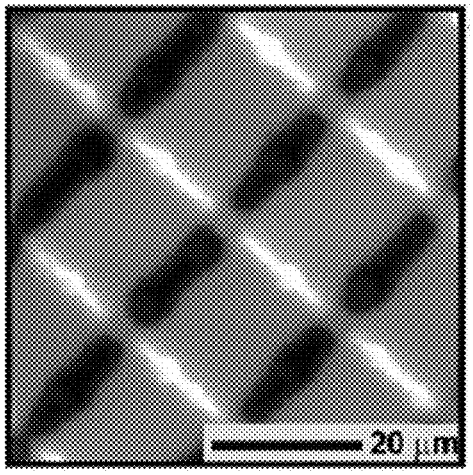
Figure 3C:
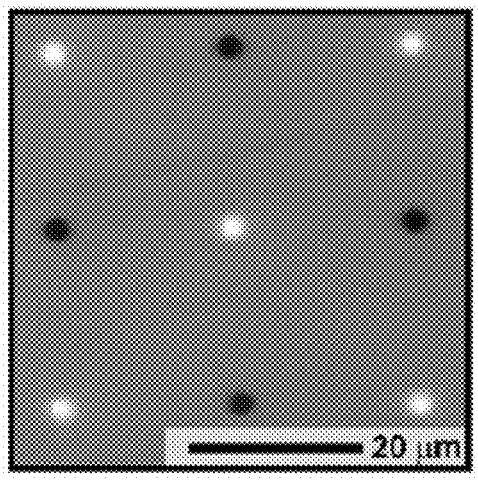
Figure 3D:
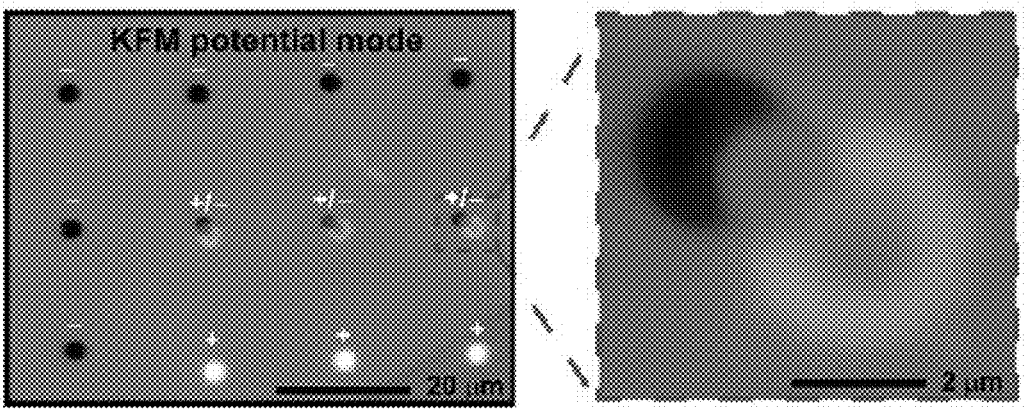

As illustrated in FIG. 1E, switching the direction of the electric field used to initiate jetting reverses the charge of the printed droplets. Controlling the bias during printing allows formation of patterns with both charge polarities. Experiments show that in most practical cases of interest, the pre-existing patterns of charge have little effect on the printing process. As a result, various functional inks with a wide range of physical properties and pH values can be successfully printed in both PPM and NPM on a single substrate. FIG. 3A shows patterns of dots with potentials of about +5.5 and −5.5 V (peak values), using an aqueous sodium phosphate solution (10 mM, pH~7) as the ink. Diameters and peak heights of dots with both polarities are ~10 μm and ~90 nm, respectively. FIG. 3B shows an array of lines patterned using the polyurethane ink (pH~5). In this case, NPM yielded an array of charged lines at −1.3 V and then PPM yielded another set of lines +1.3 V oriented at right angles to the negative lines. In both cases, the line widths are ~3 μm and thicknesses are less than 100 nm. At the crossing points, the negative and positive charges balance one another, thereby reducing the potentials in these regions to values close to 0 V. The material volumes add to yield heights of ~500 nm. FIG. 3C shows a pattern of dots (−3 μm diameters; 7 nm heights) at ca. ±2.4 V (peak values) using an organic base, quinoline (pH>8) as the ink. An aqueous suspension of DNA (5 μM) can be also printed in PPM and NPM, as shown in FIG. 3D (left side); the negative and positive dots (−3 μm diameters and ±3.5 V peak values) are labeled (−) and (+), respectively. We use the single-stranded oligonucleotide (5'-Alexa546-ACT CAC TAT TTC GAC CGG CTC GGA GAA GAG ATG TCT C-3' (SEQ ID NO:1) (HPLC), Integrated DNA Technologies Inc.) suspended in $H_2O$ without buffer but with 10 vol % of triethylene glycol to prevent nozzle clogging. The dots marked with "+/−" correspond to cases where droplets formed in PPM partially overlap (offset by ~2 μm) with droplets from NPM. Here, the NPM operation occurred before complete drying of the PPM droplets, to facilitate some mixing. The potentials at and near the areas of overlap are significantly reduced, due to charge balance.

Figure 3E:
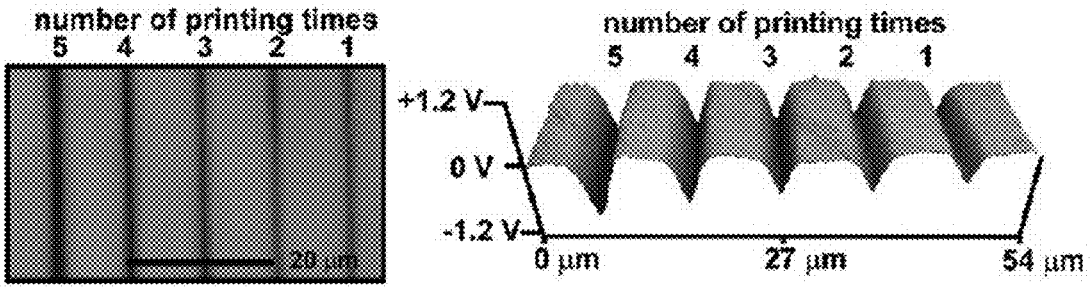

Printing in multiple passes with a common printing mode (i.e., NPM or PPM) increases the potential. As an example, charged lines printed using a 500 nm i.d. nozzle and an ink of poly(ethylene glycol) diacrylate (Sigma-Aldrich) (FIG. 3E) exhibits potentials that scale with multiple printing cycles in the expected way, from ca. —0.2 V for a single pass to ca. −1 V for five cycles. Additional cycles can increase further the potentials, although sufficiently high values can affect jetting direction, stability,[28] and threshold voltages for printing.

Figure 3F:
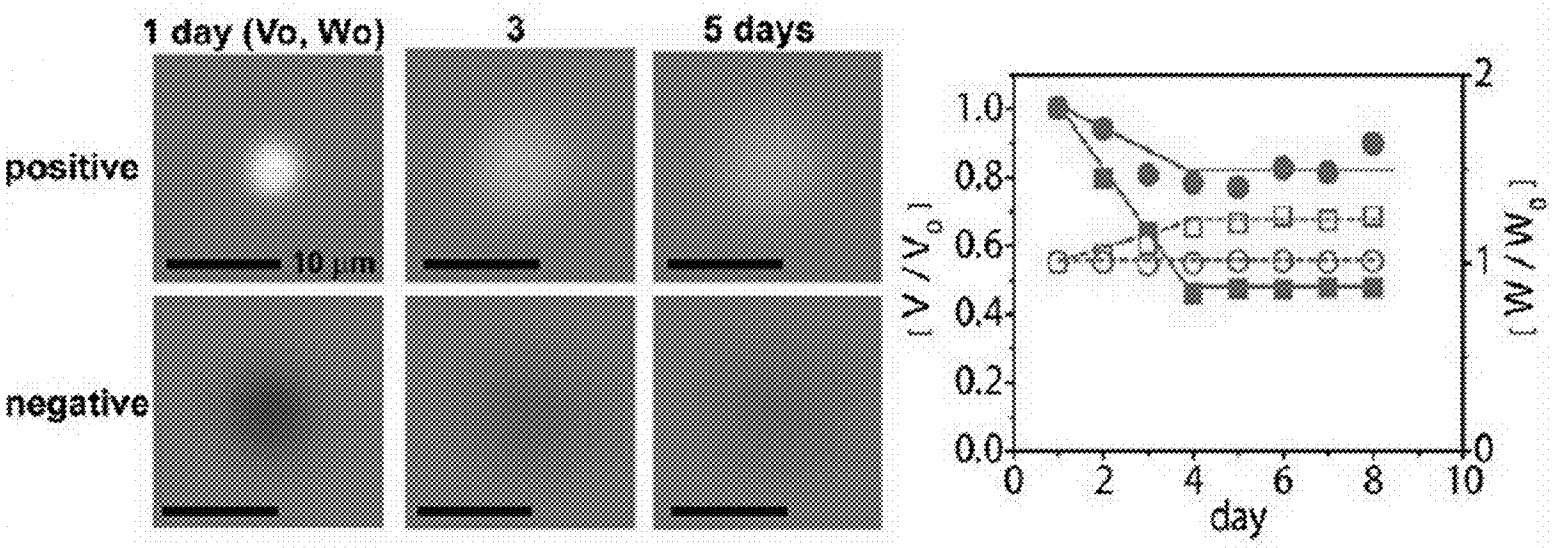
Figure 3G:
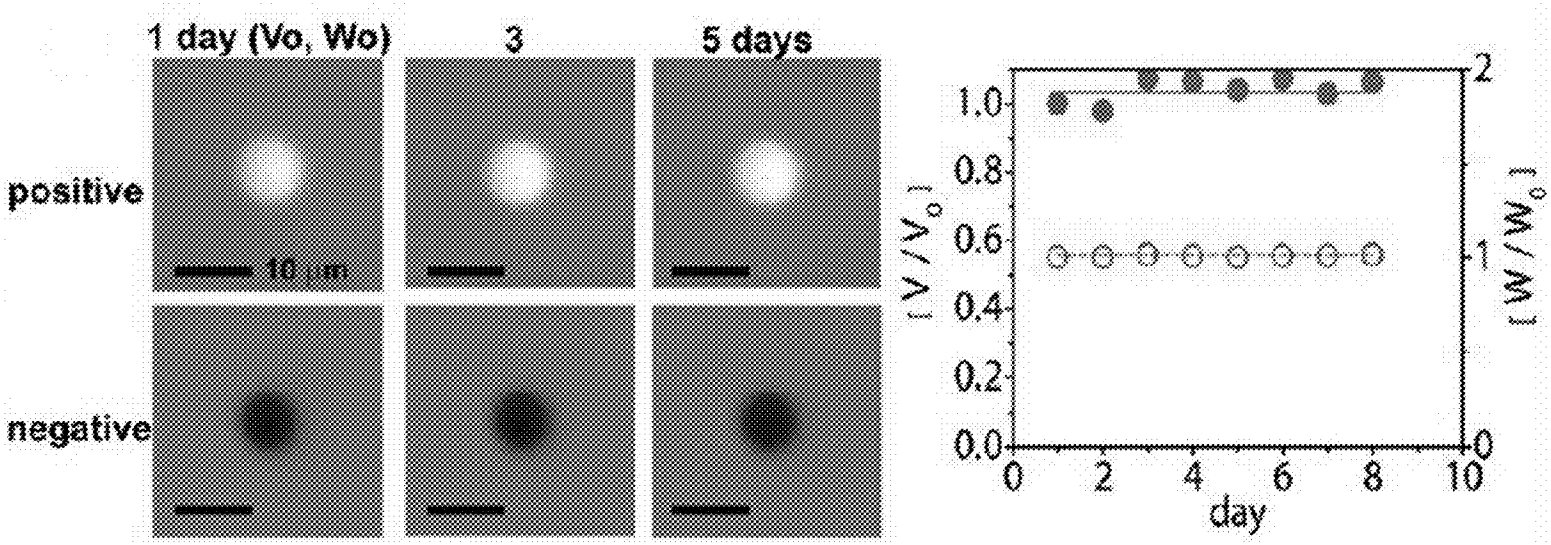
Figure 7A:
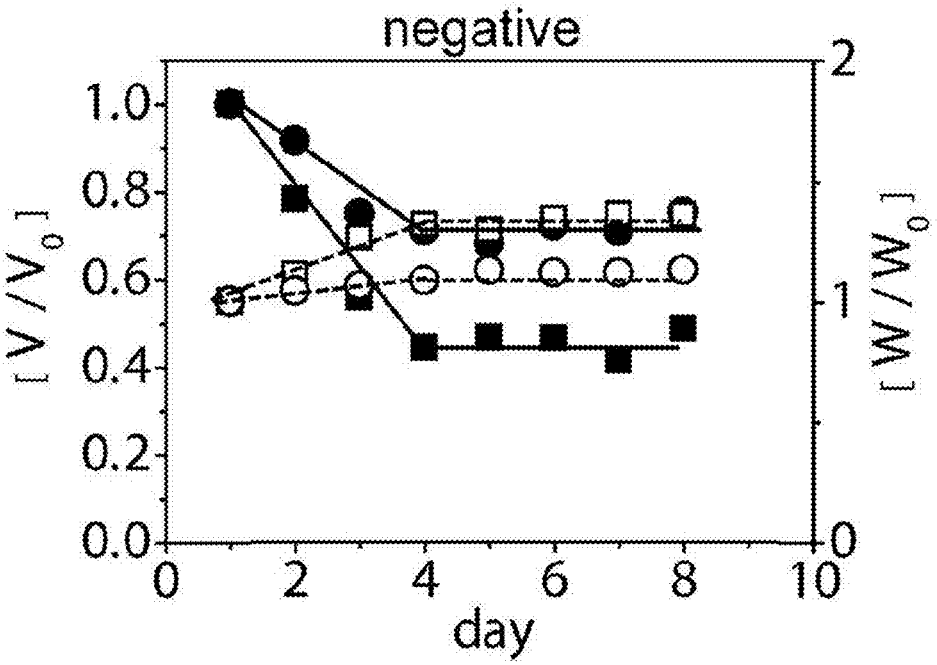
FIG. 7A-7B. Graphs of the changes in the full width at half maximum (FWHM) and peak potentials of the dots with A negative charges printed on the hydrophilic bare $SiO_2$ (squares) and hydrophobic HMDS-treated $SiO_2$ surfaces (circles). After charge printing, the samples are stored in ambient condition. The filled and vacant squares (or circles) in the graphs indicate the normalized potential [$V/V_o$] and FWHM [$W/W_o$] for the hydrophilic (or hydrophobic) surfaces, respectively. The values $V_o$ and $W_o$ correspond to the patterns formed immediately after printing. B Graphs for the aqueous NaCl ink (30% glycerin added) printed with NPM onto HMDS-treated $SiO_2$ and then stored at low humidity ($H_2O$~0.3 ppm).
Figure 7B:
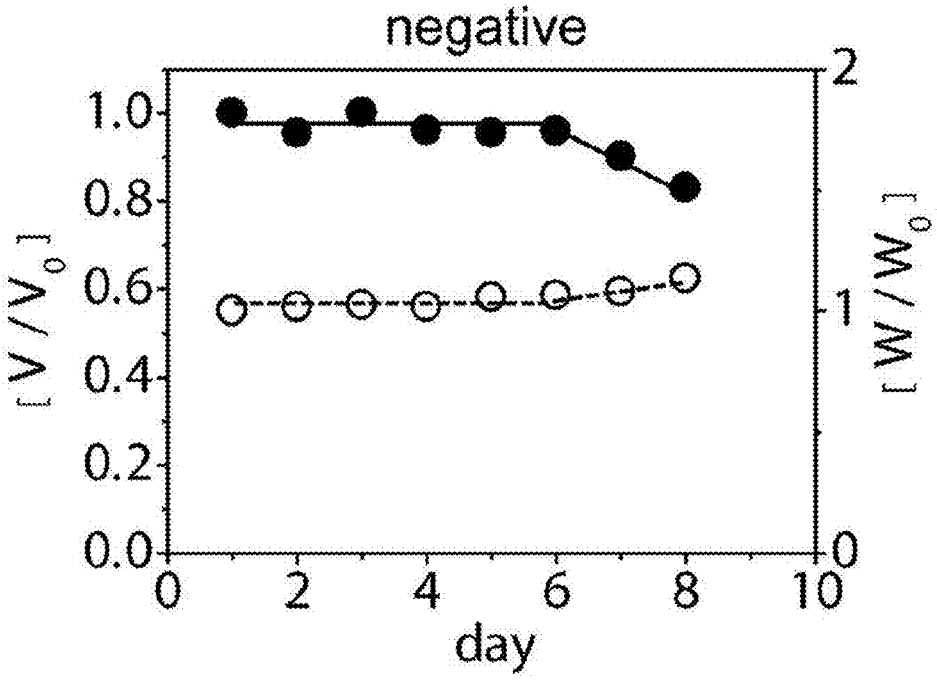
Figure 8A:
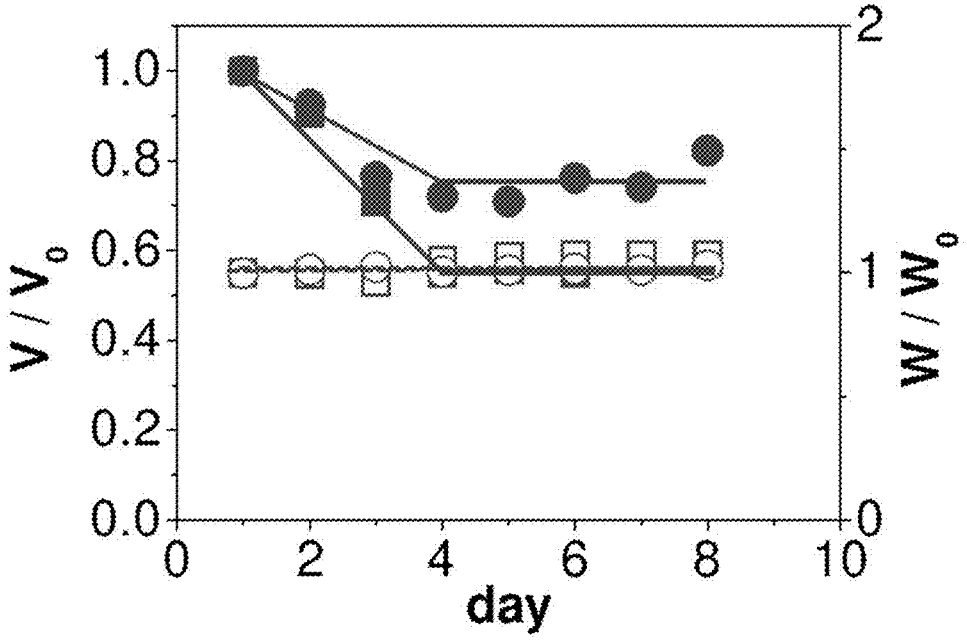
FIG. 8A-8B. Graphs showing the changes in the full width at half maximum (FWHM) and peak potentials of A positive and B negative charged dots printed on hydrophilic, bare $SiO_2$ (squares) and hydrophobic, HMDS-treated $SiO_2$ surfaces (circles). An aqueous solution of sodium phosphate provided the ink (pH~7, 30% glycerin added), and 2 μm ID nozzle was used. The filled and open squares (or circles) indicate the relative potentials [$V/V_0$] and FWHM values [$W/W_0$] for the hydrophilic (or hydrophobic) surfaces, respectively.
Figure 8B:
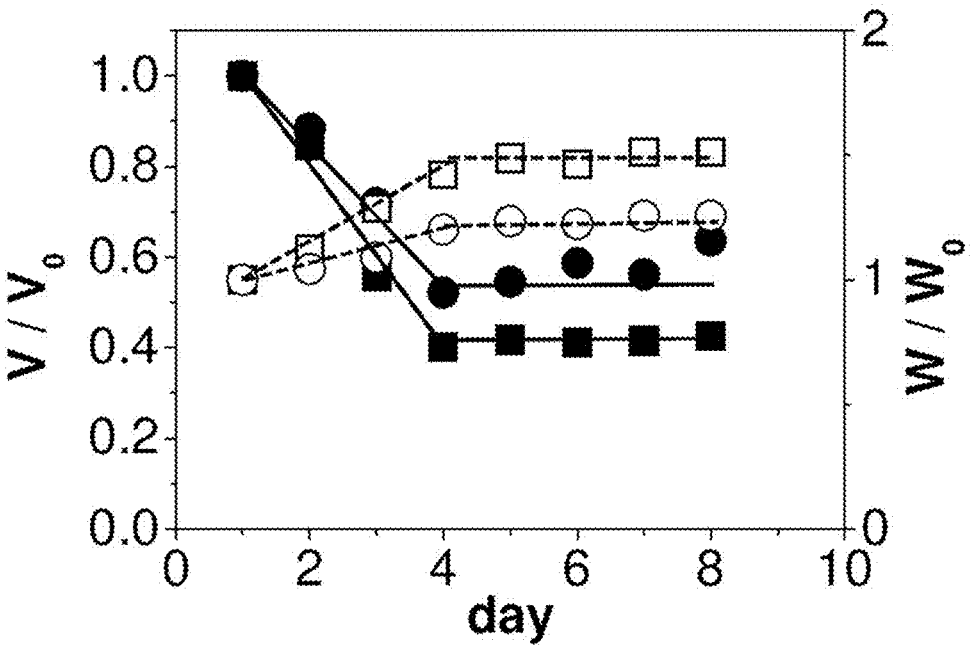
Figure 9A:
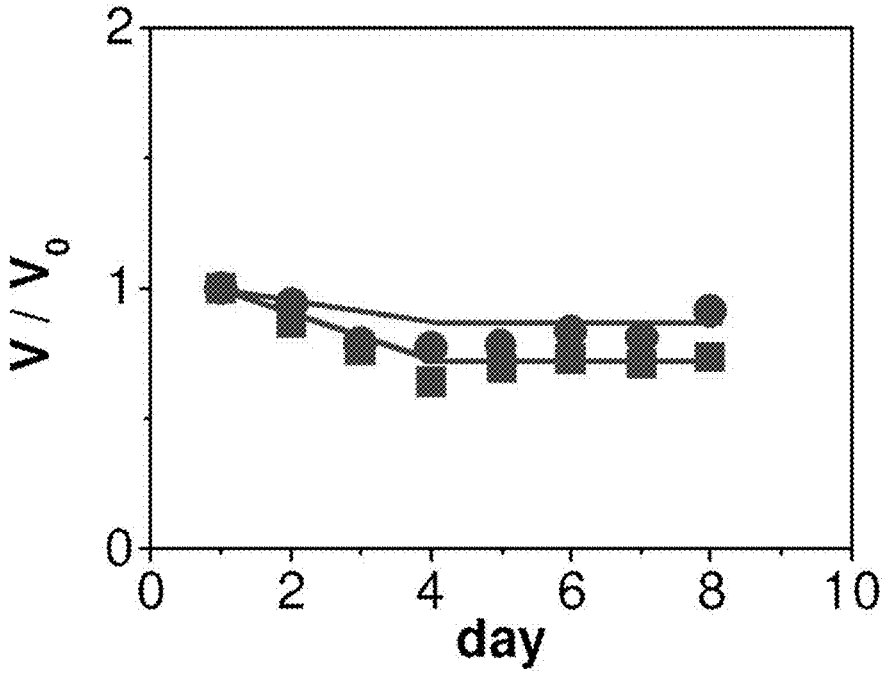
FIG. 9A-9D. Time dependence of the integrated potentials for A positive and B negative charges printed using the aqueous sodium chloride ink (30% glycerin added), C positive and D negative charges printed using the aqueous sodium phosphate ink (pH~7, 30% glycerin added). To calculate the overall potentials [$\pi\times(FWHM/2)^2\times$potential at half maximum], the values of the FWHM and the potential at half maximum in FIG. 3 and FIG. 6 were used. The squares (or circles) in the graphs indicate the relative overall potentials [$V/V_0$] for the hydrophilic (or hydrophobic) surfaces, respectively.
Figure 9B:
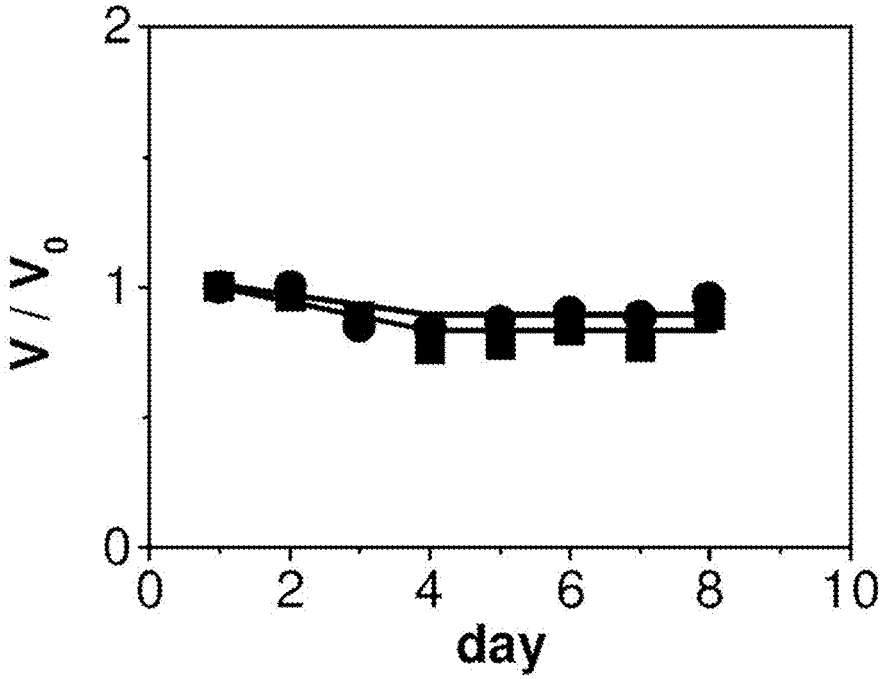
Figure 9C:
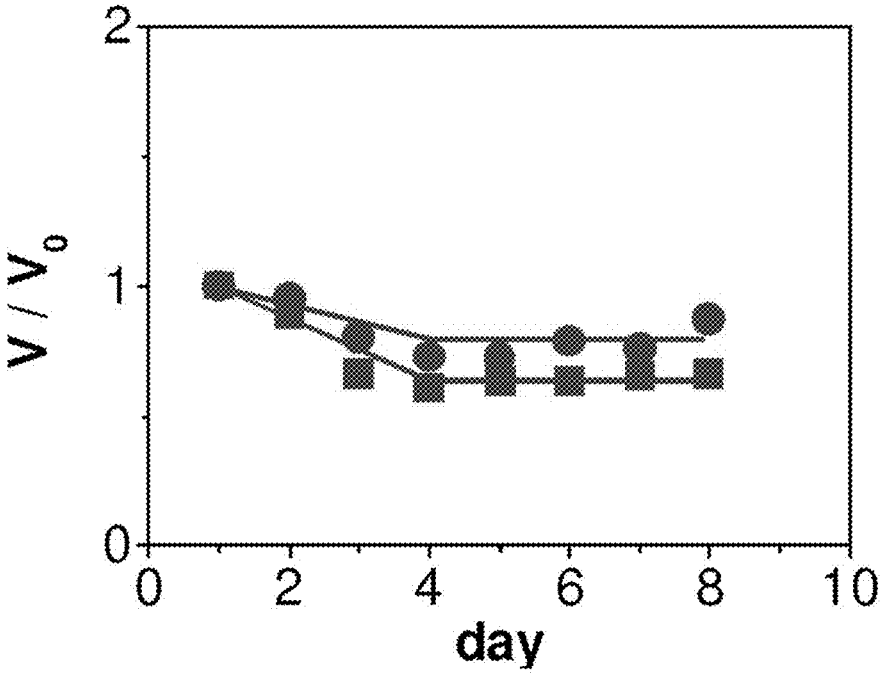
Figure 9D:
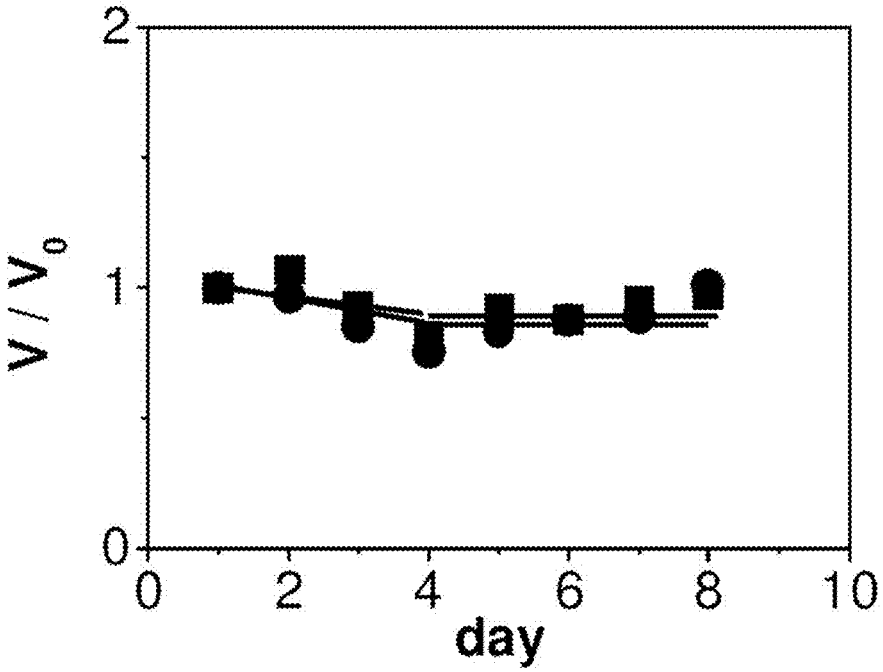

Both positive and negative patterns of charge persist for times that depend on environmental factors including humidity and substrate properties such as hydrophobicity.[9,12] We studied the dissipation of charges patterned by e-jet with an aqueous sodium chloride ink (1 mM, 30 wt % glycerin added to avoid nozzle clogging) on substrates of $SiO_2$/Si untreated and treated with HMDS. FIG. 3F-3G present some results. In ambient conditions, the peak potentials decrease rapidly during the first few days due to lateral spreading of charge and then continue to decrease very slowly without significant additional spreading (curves of FIG. 3F and FIG. 7A). A sodium phosphate ink (1 mM, glycerin 30 wt %) exhibits similar behaviors, as shown in FIG. 8A-8B. The temporal decay in the potential and the associated lateral spreading can be significantly slowed (to ~20% decrease over a week) by increasing the hydrophobicity of the substrate via the formation of a monolayer of HMDS on the surface of the $SiO_2$. Calculation of the integrated potentials suggests that lateral spreading is accompanied by some degree of charge dissipation/neutralization (FIG. 9A-9D). Also, we observe that the initial rates of decay of negative potentials are typically somewhat (10-20%) faster than the rates for positive potentials. These trends, which are similar to those in corona discharge and contact electrification,[3,12,29,30] suggest that the underlying processes are mediated by water adsorbed on the surface of the substrate. Counterions, including $H_3O^+$, from the condensed water can neutralize some of the printed charge and facilitate its diffusion on the surface.[3,12] (The e-jet printed charge patterns disappear entirely upon rinsing of the substrate with deionized water.) As further evidence of this mechanism, we observe nearly complete retention of potentials and sizes in patterns of printed dots by storing them in an environment with low humidity ($H_2O$~0.3 ppm) and exposing to ambient air only for sufficient time (−4 h) for each KFM measurement. As shown in FIG. 3G, in such cases the potentials of both positive and negative patterns remains constant for 5 days with negligible lateral spreading. The ~15% decay of the negative potential for the sixth to eighth days results primarily for exposure to ambient air during the KFM measurements (FIG. 7A-7B).

Figure 4A:
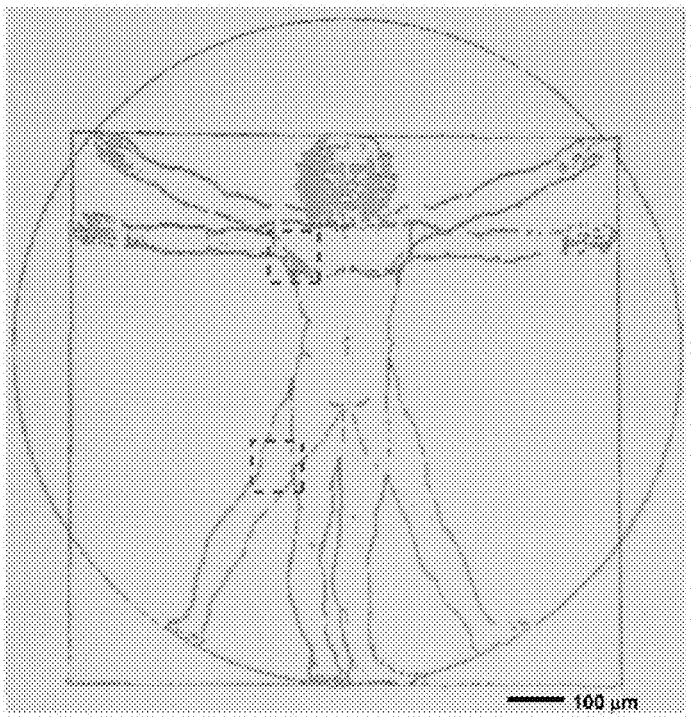
FIG. 4A-4E. Complex image printing with positive and negative charges fully integrated with one another. A Optical micrograph of the e-jet printed Vitruvian man. B Magnified view of the head area. C Original sketch by Leonardo da Vinci (two lines indicate areas printed for positive and negative charges, respectively). D SEM image of the e-jet printed pattern (positive and negative charges appear dark and bright, respectively). E 3D KFM images for top and bottom rectangular regions in A.
Figure 4B:
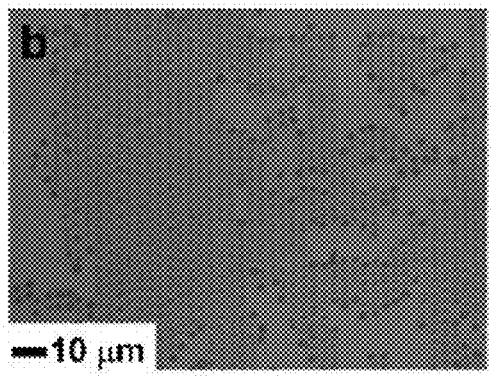
Figure 4C:
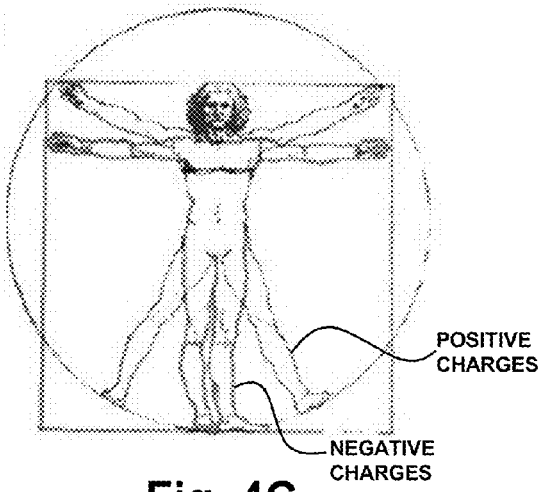
Figure 4D:
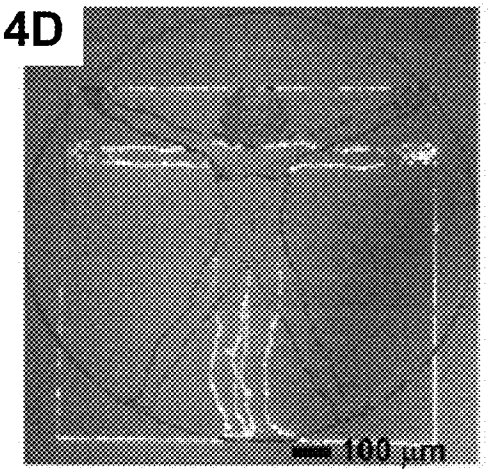
Figure 4E:
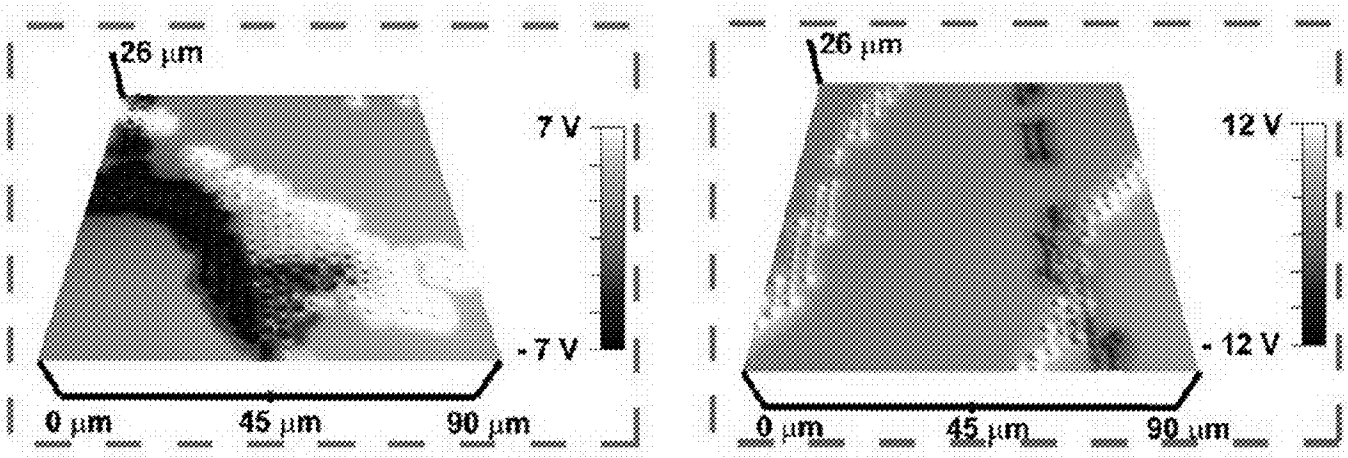
Figure 10A:
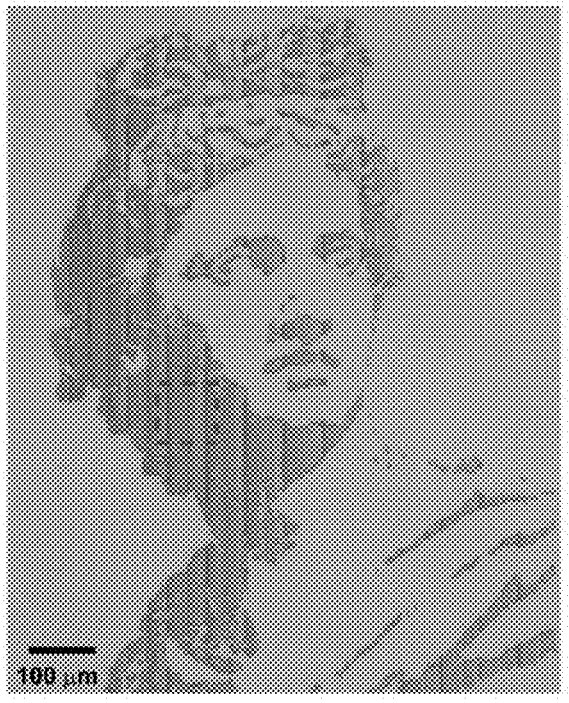
FIG. 10A-10D. Complex image printing with positive and negative charges separated into stripes. A Optical micrograph of the e-jet printed Apollo image with positive and negative charges. B Sketch of the original statue (dark and lighter lines indicate areas for positive and negative charges, respectively). C 3D KFM images for the boxed-dashed region in A. D SEM images of the e-jet printed pattern.
Figure 10B:
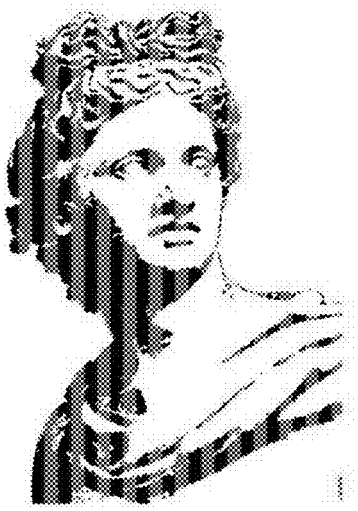
Figure 10C:
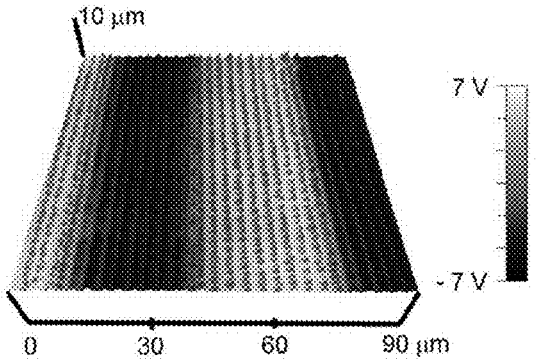
Figure 10D:
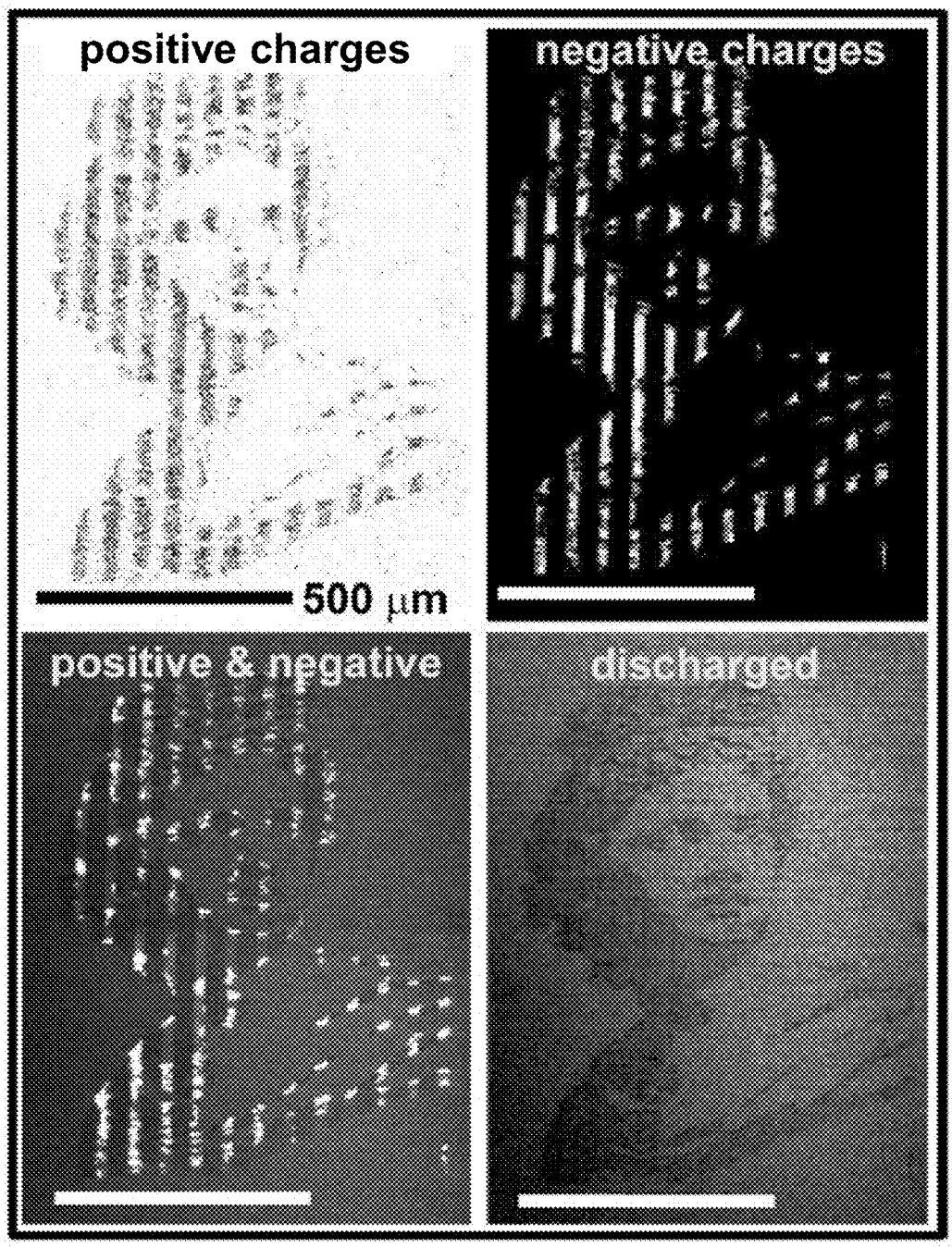

The capability of the e-jet printer to select the charge polarity "on the fly" during a single patterning operation enables formation of complex configurations of charge, including in the form of digitized graphic art images, circuit structures, or related, with desired spatial variations in signs and magnitudes of the potentials. As an example, a drawing of Vitruvian man by Leonardo da Vinci is e-jet printed using polyurethane ink with a 1 μm i.d. nozzle on a HMDS-treated $SiO_2$ surface. FIG. 4A provides an optical image of the result. As shown in the magnified view of the head area (FIG. 4B), the image consists of a matrix of dots, with diameters and horizontal spacing of ~1.5 and ~3 μm, respectively. The body outline and area inside the circle are printed in PPM and NPM, respectively, as depicted in FIG. 4C. An SEM image (with a secondary electron detector) of the pattern appears in FIG. 4D. Areas with positive and negative potentials appear darker and brighter, respectively, due to different effects on the electron beam used for imaging (500 eV energy in this case). The number of the secondary electrons that originate from the areas of positive potential is smaller than that from the negative potential regions, as might be expected simply due to electrostatics. This SEM contrast is sufficient to distinguish differences in polarity, at least at a qualitative level, across the entire image, corresponding to areas that are much larger than those that can be examined in a single KFM image. The contrast in the SEM, however, decreases with duration of exposure to the electron beam, likely due to charge neutralization associated with the electrons. Focusing with higher magnification and increasing the beam energy tended to accelerate the rate of this the neutralization. The Vitruvian pattern is scanned using KFM (FIG. 4E) before SEM observation, to allow independent identification of the positive and negative regions. The peak potentials, thicknesses, and dot diameters are ca. ±5 V, 260 nm, and 2 μm, respectively. As with the results shown in FIG. 3B, the potentials are neutralized in locations where the positive and negative charges overlap. To illustrate a different but related capability, FIG. 10A-10C shows a printed image of the Apollo statue, in which regions of different charge are separated into stripes. FIG. 10A shows an optical micrograph of the printed image and FIG. 10B illustrates the areas intended for positive and negative charge. As shown in the KFM image (FIG. 10C), these stripes are located immediately next to one another and have potentials of ca. ±5 V. Similar to the results of FIG. 4C, areas with negative potentials appear significantly brighter than the positive regions under the SEM (500 eV).

Figure 5A:
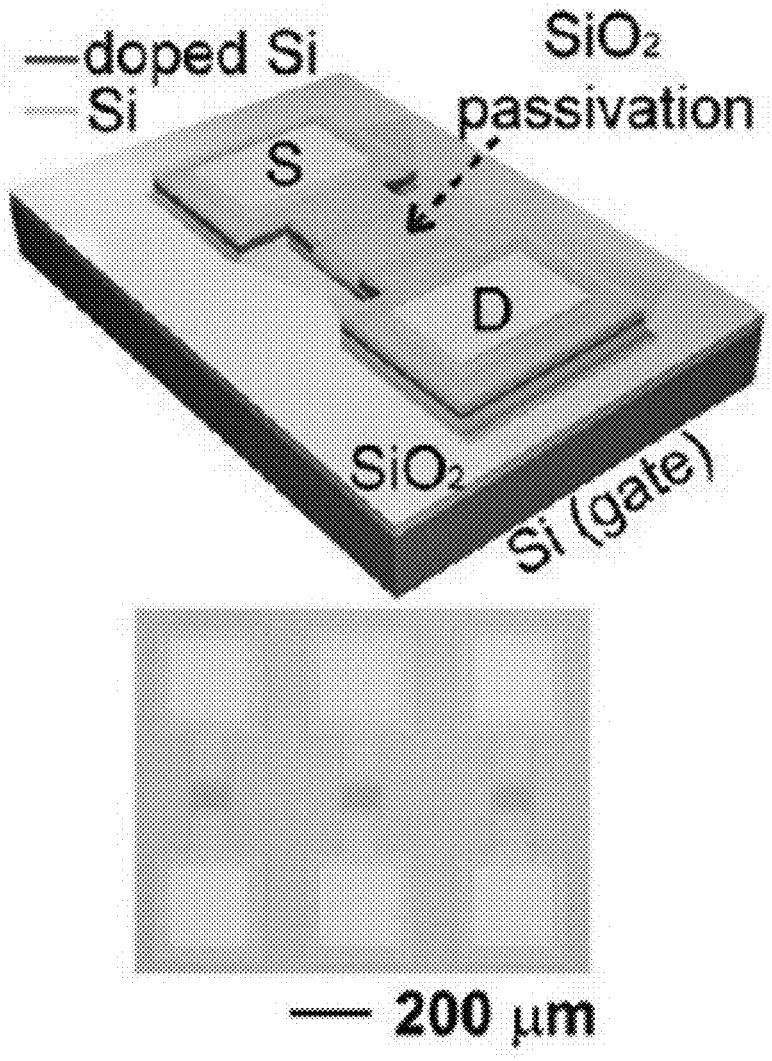
FIG. 5A-5I. Electrostatic doping of silicon nanomembrane transistors using e-jet printed charges. A Schematic illustration (top) of the device layout and optical micrograph (bottom) of a set of devices (channel length, 75 μm; width, 100 μm). B $V_g$–$I_d$ curves at $V_d$=0.1 V. C $V_d$–$I_d$ characteristics before charge printing. D Schematic illustration of charge printed onto the center of the transistor channel coated with a layer of $SiO_2$. E SEM image of channel areas with printed charge (positive and negative charges appear dark and bright, respectively). F KFM images of the printed regions (left, +1 V; right, −1 V in peak potentials). G Shift of the threshold voltage by the printed charges. $V_d$–$I_d$ characteristics after printing H positive and I negative charges.
Figure 5B:
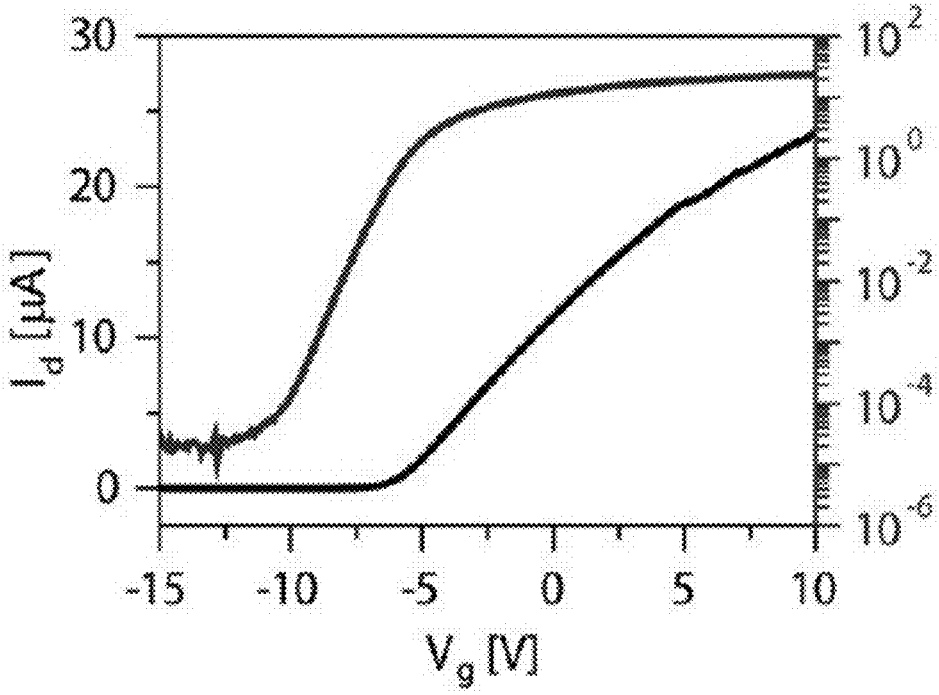
Figure 5C:
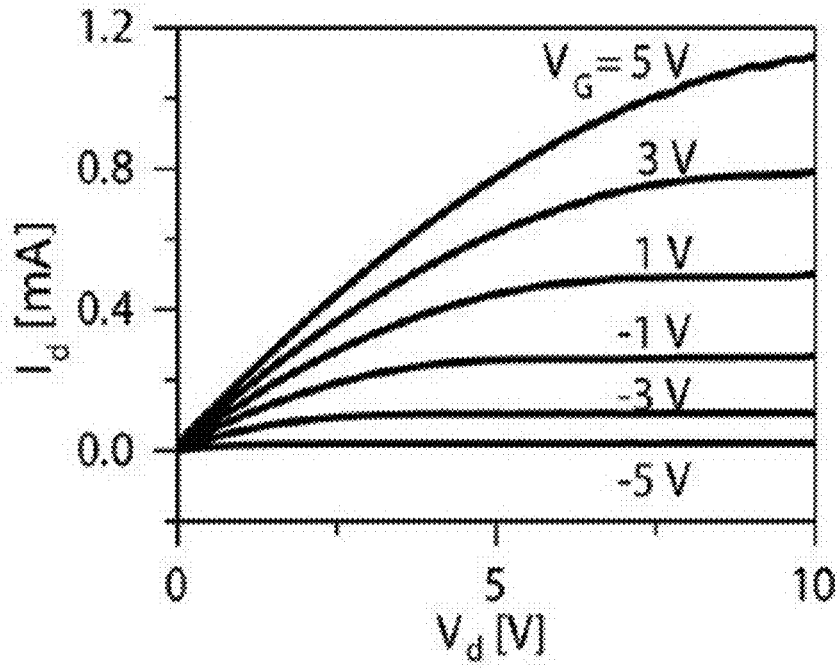
Figure 5D:
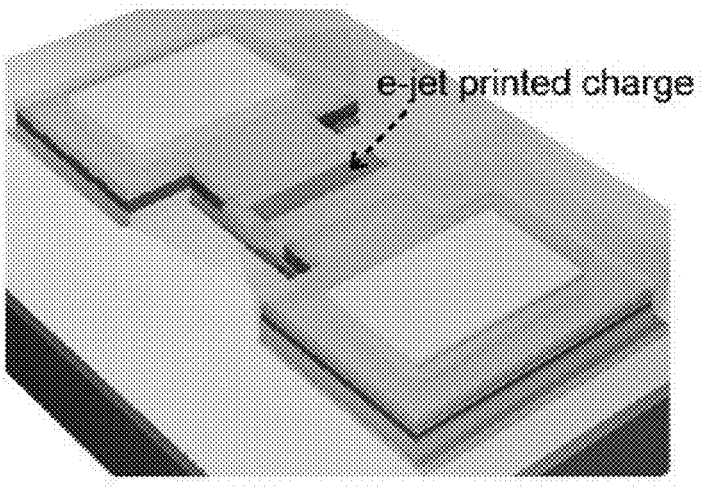
Figure 5E:
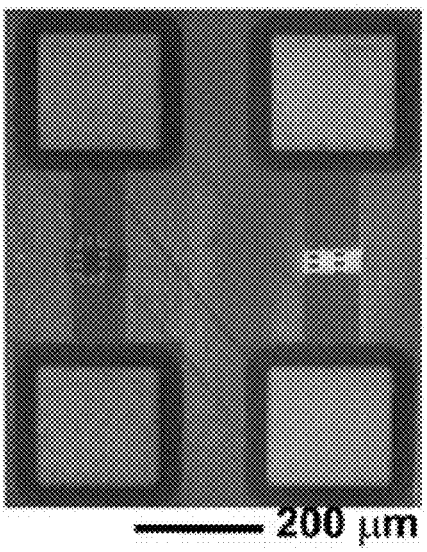
Figure 5F:
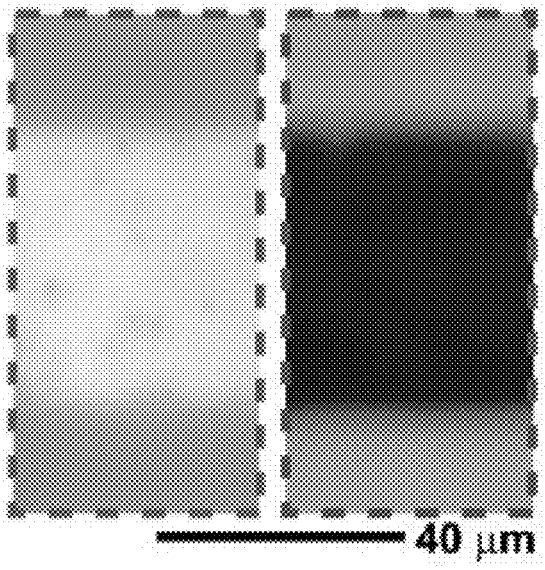
Figure 5G:
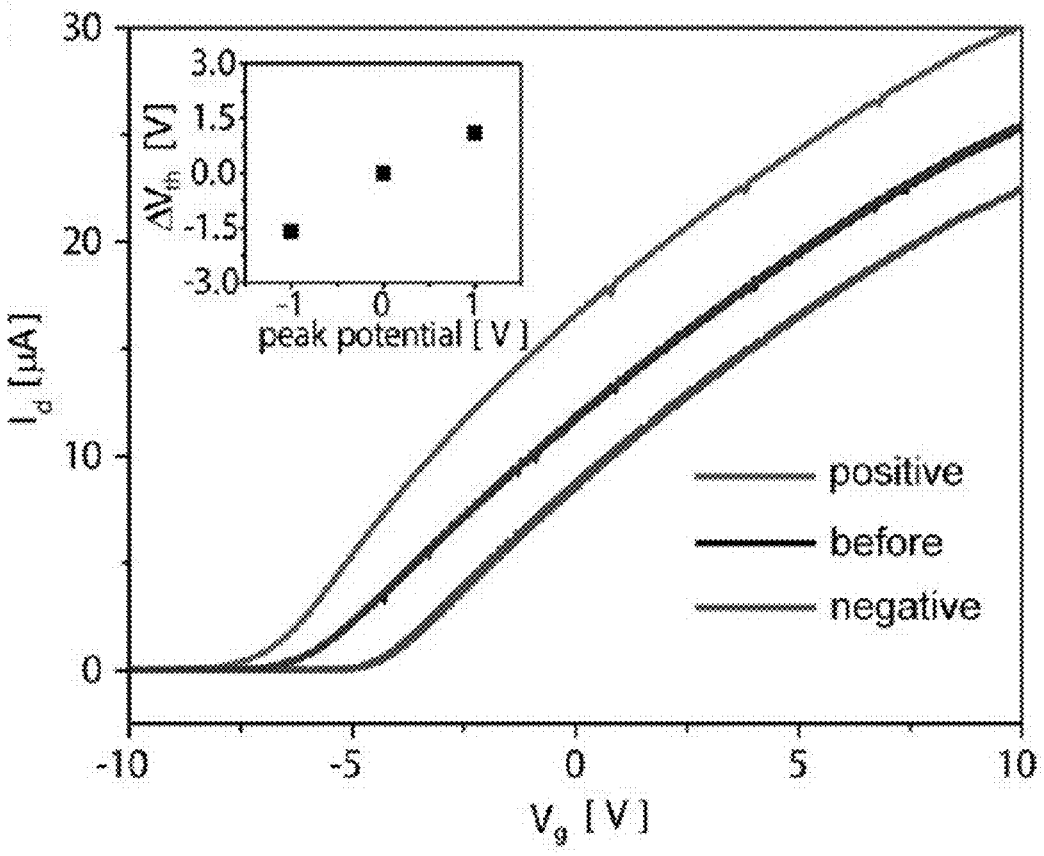
Figure 5H:
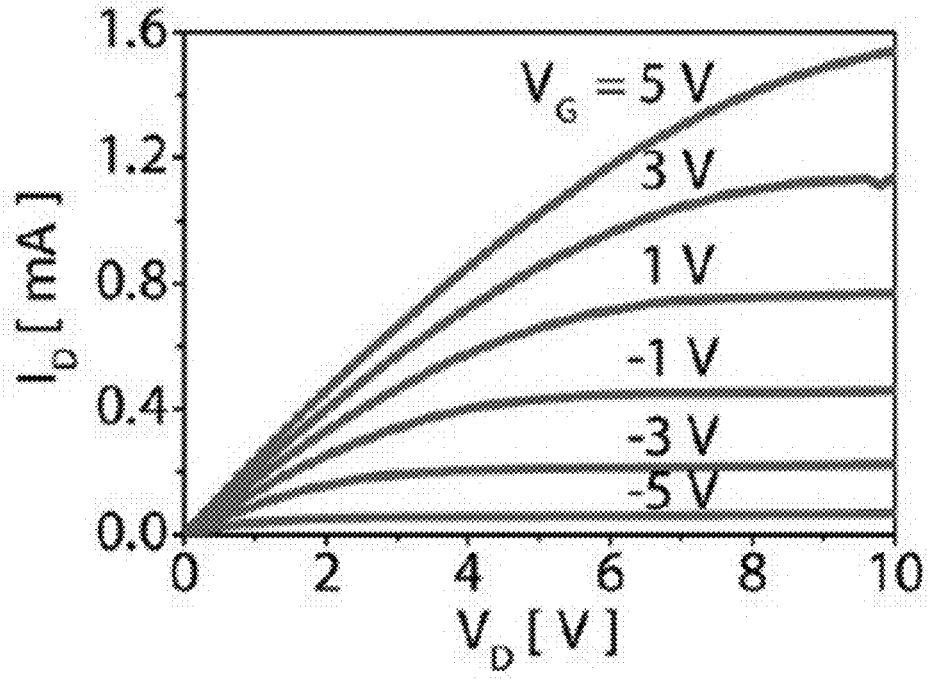
Figure 5I:
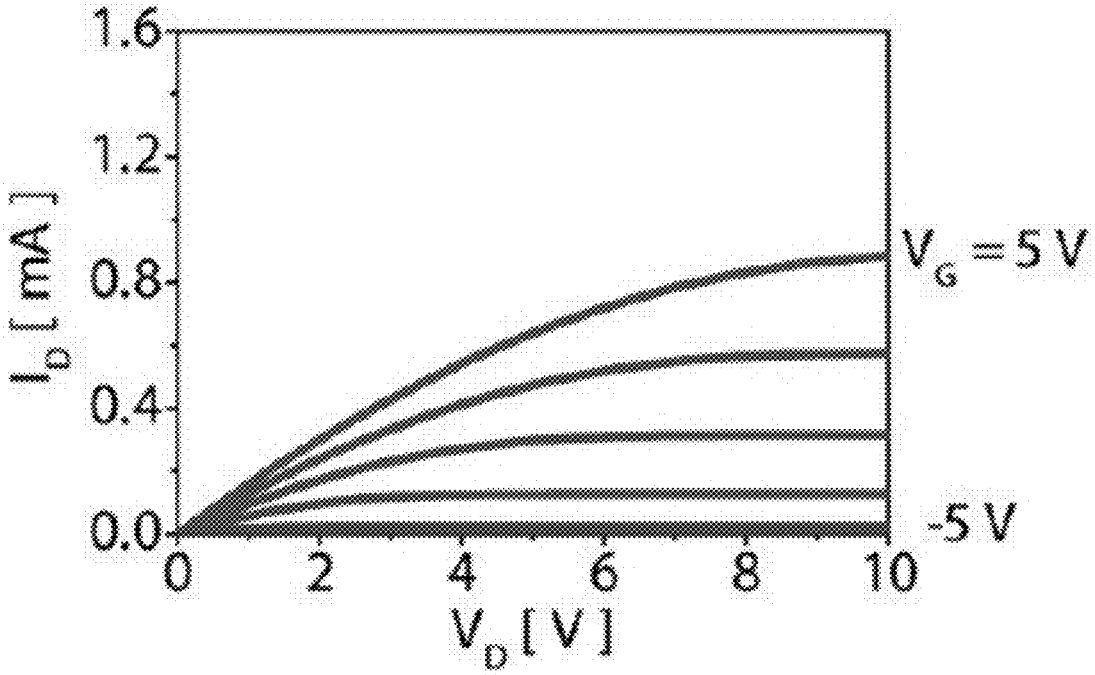

Such patterns of charge can be used in functional devices. FIG. 5A-5I demonstrates an example in the control of properties of silicon nanomembrane transistors. In particular, we use printed charge to pattern regions of electrostatic doping for the purpose of manipulating the threshold voltages, in a manner conceptually similar to recent demonstrations using electrets with organic transistors.[31-33] In our case, the transistors use 55 nm thick monocrystalline silicon membranes[34] formed from the top silicon layer of a silicon-on-insulator wafer, with 145 nm buried $SiO_2$. Patterned doping with phosphorus provides Ohmic contacts for n channel devices with channel lengths and widths of 75 and 100 μm, respectively. The silicon wafer provides a back gate. A 100 nm layer of $SiO_2$ deposited on top of the silicon in the channel region and treated with HMDS serves as a platform for e-jet printed charge. FIG. 5A shows a schematic diagram of the device layout and an optical micrograph of representative devices (before printing). FIG. 5B-5C show plots of the drain current ($I_d$) as a function of the gate voltage ($V_g$) (at a drain bias, $V_d$, of 0.1 V) and sets of $I_d$–$V_d$ curves at various $V_g$, respectively. The threshold voltage ($V_{th}$) and the on/off ratio are ca. −6.0 and ~$10^6$, respectively. The device mobility evaluated in the linear regime is ~600 $cm^2$ $V^{-1}$ $s^{-1}$. Positive (or negative) charges are printed using e-jet onto the top $SiO_2$ layer (center part of the device channel, 15 μm away from each edge of S/D), as illustrated in FIG. 5D. An aqueous 10 mM sodium chloride ink (10% glycerol added) is used with a 2 μm i.d. nozzle. As shown in the SEM image (FIG. 5E), the areas printed with positive charges (or negative charges) appear darker (or brighter) than the nonprinted areas, similar to the cases of FIG. 4 and FIG. 9. The peak potentials evaluated by KFM before SEM imaging are +1 or −1 V (FIG. 5F). As shown in FIG. 5G, $V_{th}$ moves toward the negative (or positive) $V_g$ direction by printing positive (or negative) charges by somewhat more than 1 V in each case (inset of FIG. 5G), as might be expected due to the somewhat higher capacitances of the top $SiO_2$ than the gate dielectric. The $I_d$–$V_d$ characteristics also change in a consistent manner (FIG. 5H-5I).

This example demonstrates that nanoscale electrified fluid jets can be used for high-resolution patterning of charge, to provide capabilities that are unavailable in other methods. Positive and negative potentials with well-defined magnitudes can be printed using various inks, ranging from polymers to metallic nanoparticles, nanowires, and DNA, and substrate combinations, each with nanoscale resolution. Control over the behavior of silicon nanomembrane transistors provides an example of the use of this method for controlling the properties of nanoscale electronic devices. Developing the technique to allow for even larger potentials and finer features and exploring application opportunities in optoelectronics, sensors, and biotechnology appear to be promising directions for future work.

Methods: Preparation of the substrate. Si wafers with 100 nm thick layers of thermal $SiO_2$ (Process Specialties, Inc) serves as substrates. Prior to printing, the wafers are cleaned thoroughly with piranha solution followed by a rinse with de-ionized water. For KFM measurements, photolithographically defined contact pads of Cr (2 nm thickness)/Au (100 nm) were formed on regions of the silicon wafer where the $SiO_2$ was removed with HF. In most cases, the $SiO_2$ surface (i.e. the region of the substrate to be printed) was exposed to HMDS (Across) vapor for 5 min in a desiccator. The control experiments in FIG. 3A-3C do not involve exposure.

E-jet printer. The specific setup information appears elsewhere[14,15]. During printing, voltage is applied to a metal coating on the nozzles, while the substrate is grounded (through metal contacts formed on the Si in the case of $SiO_2$/Si). All printing is performed in ambient air, at room temperature.

Device fabrication. N-channel metal oxide semiconductor field effect transistors (n-MOSFETs) are fabricated from p-type SOI wafers (SOITEC; Soitec unibond with a 55 nm top Si layer and 145 nm buried oxide). Silicon oxide ($SiO_2$) with a thickness of 300 nm is deposited on the SOI wafer using a plasma-enhanced chemical-vapor deposition (PECVD), to provide a diffusion mask for the doping process. Source and drain windows through this $SiO_2$ layer are formed by photolithography, reactive ion etching (RIE) ($CF_4/O_2$ at 40/1.2 sccm, 50 mTorr, 150 W) and etching with buffered oxide etchant (BOE). After the removal of photoresist by rinsing with acetone, isopropyl alcohol and deionized (DI) water, and dipping into piranha solution, phosphorous spin-on dopant (SOD, P509; Filmtronic) is applied by spin-casting. For the diffusion of phosphorous, rapid thermal annealing is performed at 950° C. for 10 s. Both the SOD and the diffusion mask are removed by dipping the wafers in a hydrofluoric acid (HF) solution (49%) for 3 min and then the wafers are thoroughly rinsed with DI water. Silicon nanomembranes with a dumbbell shape (midsection: 300 μm in length and 100 μm in width, dumbbell heads: 300 μm in length and 300 μm in width) are defined by photolithography and RIE ($SF_6$ at 40 sccm, 50 mTorr, 100 W) process. A 100 nm layer of PECVD $SiO_2$ serves as a top dielectric. Contact holes for source and drain electrodes are formed by photolithography and etching process (6:1 BOE). The source and drain pads (L: 200 μm, W: 200 μm) of Cr/Au (5 nm/150 nm) are deposited by electron beam evaporation and patterned by photolithography and liftoff. The devices have channel lengths and widths of 75 μm and 100 μm, respectively. For testing, the handle wafer of the SOI substrate provides a back gate. The devices are thermally annealed at 300° C. for 4 h in a $N_2$ atmosphere and then subsequently hydrophobically-modified using HMDS vapor.

Electrostatic doping process. Aqueous sodium chloride (Sigma-Aldrich) solution with a concentration of 10 mM serves as an ink for the charge printing on the silicon devices described above. To retard nozzle clogging caused by solvent evaporation, 10% glycerin (Sigma-Aldrich) was added into the ink. Positive (or negative) charges were printed on the middle part of the channel area (L: 75 μm and W: 100 μm) on the top dielectric, for the purpose of controlling the threshold voltage in the devices. The printed areas were 45 μm (L)×100 μm (W).

REFERENCES (1) Duke, C. B.; Noolandi, J.; Thieret, T. Surf. Sci. 2002, 500, 1005-1023.

(2) Pai, D. M.; Springett, B. E. Rev. Mod. Phys. 1993, 65, 163-211.

(3) Ressier, L.; Nader V Le., Nanotechnology 2008, 19, 135301.

(4) Seemann, L.; Stemmer, A.; Naujoks, N. Nano Lett. 2007, 7, 3007.

(5) Mesquida, P.; Stemmer, A. Adv. Mater. 2001, 13, 1395.
(6) Tzeng, S.-D.; Lin, K.-J.; Hu, J.-C.; Chen, L.-J.; Gwo, S. Adv. Mater. 2006, 18, 1147.
(7) Pingree, L. S. C.; Reid, 0. G.; Ginger, D. S. Adv. Mater. 2009, 21, 19-28.
(8) Lenggoro, I. W.; Lee, H. M.; Okuyama, K. J. Colloid Interface Sci. 2006, 303, 124-130.
(9) Jacobs, H. O.; Whitesides, G. M. Science 2001, 291, 1763-1766.
(10) Barry, C. R.; Gu, J.; Jacobs, H. O. Nano Lett. 2005, 5, 2078.
(11) Jacobs, H. O.; Campbell, S. A.; Steward, M. G. Adv. Mater. 2002, 14, 1553.
(12) McCarty, L. S.; Whitesides, G. M. Angew. Chem., Int. Ed. 2008, 47, 2188-2207.
(13) Genda, T.; Tanaka, S.; Esashi, M. 17th IEEE International Conference on Micro Electro Mechanical Systems 2004, 470-473.
(14) Park, J.-U.; et al. Nat. Mater. 2007, 6, 782-789.
(15) Park, J.-U.; Lee, J. H.; Paik, U.; Lu, Y.; Rogers, J. A. Nano Lett. 2008, 8, 4210.
(16) Choi, H. K.; et al. Appl. Phys. Lett. 2008, 92, 123109.
(17) Sekitani, T.; Noguchi, Y.; Zschieschang, U.; Klauk, H.; Someya, T. Proc. Natl. Acad. Sci. U.S.A. 2008, 105, 4976-4980.
(18) Taylor, G. I. Proc. R. Soc. London, Ser. A 1969, 313, 453-475.
(19) Collins, R. T.; Jones, J. J.; Harris, M. T.; Basaran, O. A. Nat. Phys. 2008, 4, 149-154.
(20) Hayati, I.; Bailey, A. I.; Tadros Th., F. Nature 1986, 319, 41-42.
(21) Marginean, I.; Nemes, P.; Vertes, A. Phys. Rev. Lett. 2006, 97, 064502.
(22) Saville, D. A. Annu. Rev. Fluid Mech. 1997, 29, 27-64.
(23) Juraschek, R.; Rollgen, F. W. Int. J. Mass. Spectrom. 1998, 177, 1-15.
(24) Sun, Y.; Xia, Y. Adv. Mater. 2002, 14, 833-837.
(25) Lord Rayleigh, Philos. Mag. 1882, 14 (5th), 184-185.
(26) Marginean, I.; Znamenskiy, V.; Vertes, A. J. Phys. Chem. B 2006, 110, 6397-6404.
(27) Gomez, A.; Tang, K. Q. Phys. Fluids 1994, 6, 404-414.
(28) Korkut, S.; Saville, D. A.; Aksay, I. A. Phys. Rev. Lett. 2008, 100, 034503.
(29) Schonenberger, C. Phys. Rev. B 1992, 45, 3861-3864.
(30) Olthuis, W.; Bergveld, P. IEEE Trans. Electr. Insul. 1992, 27, 691-697.
(31) Huang, C.; Katz, H. E.; West, J. E. J. Appl. Phys. 2006, 100, 114512.
(32) Huang, C.; West, J. E.; Katz, H. E. Adv. Funct. Mater. 2007, 17, 142.
(33) Scharnberg, M.; Zaporojtchenko, V.; Adelung, R.; Faupel, F.; Pannemann, C.; Diekmann, T.; Hilleringmann, U. Appl. Phys. Lett. 2007, 90, 013501.
(34) Sun, Y.; Choi, W. M.; Jiang, H.; Huang, Y. Y.; Rogers, J. A. Nat. Nanotechnol. 2006, 1, 201-207.
(35) Sun, Y.; Xia, Y. J. Am. Chem. Soc. 2004, 126, 3892.

STATEMENTS REGARDING INCORPORATION BY REFERENCE AND VARIATIONS

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description. As will be obvious to one of skill in the art, methods and devices useful for the present methods can include a large number of optional composition and processing elements and steps.

When a group of substituents is disclosed herein, it is understood that all individual members of that group and all subgroups, including any isomers, enantiomers, and diastereomers of the group members, are disclosed separately. When a Markush group or other grouping is used herein, all individual members of the group and all combinations and subcombinations possible of the group are intended to be individually included in the disclosure. When a compound is described herein such that a particular isomer, enantiomer or diastereomer of the compound is not specified, for example, in a formula or in a chemical name, that description is intended to include each isomers and enantiomer of the compound described individual or in any combination. Additionally, unless otherwise specified, all isotopic variants of compounds disclosed herein are intended to be encompassed by the disclosure. For example, it will be understood that any one or more hydrogens in a molecule disclosed can be replaced with deuterium or tritium. Isotopic variants of a molecule are generally useful as standards in assays for the molecule and in chemical and biological research related to the molecule or its use. Methods for making such isotopic variants are known in the art. Specific names of compounds are intended to be exemplary, as it is known that one of ordinary skill in the art can name the same compounds differently.

Every formulation or combination of components described or exemplified herein can be used to practice the invention, unless otherwise stated.

Whenever a range is given in the specification, for example, a temperature range, a degradation range, charge range, potential range, dimension range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art. For example, when composition of matter are claimed, it should be understood that compounds known and available in the art prior to Applicant's invention, including compounds for which an enabling disclosure is provided in the references cited herein, are not intended to be included in the composition of matter claims herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

SEQUENCE LISTING

```
<160> NUMBER OF SEQ ID NOS: 1

<210> SEQ ID NO 1
<211> LENGTH: 37
<212> TYPE: DNA
<213> ORGANISM: Artificial Sequence
<220> FEATURE:
<223> OTHER INFORMATION: synthetic sequence

<400> SEQUENCE: 1

actcactatt tcgaccggct cggagaagag atgtctc                    37
```

We claim:

1. A method of printing a pattern of charge on a substrate surface, said method comprising the steps of:

providing a nozzle containing a printable fluid comprising a net charge suspended in a suspending fluid;

providing a substrate having a substrate surface;

generating from the nozzle an ejected printable fluid containing suspending fluid and net charge;

directing the ejected printable fluid containing net charge to the substrate surface, wherein the net charge does not substantially degrade and the suspending fluid evaporates so that there is minimal transfer of the suspending fluid to the substrate; and retaining the net charge on the substrate surface, thereby printing a pattern of charge on the substrate surface;

wherein the printed pattern of charge comprises a plurality of dots of charge that form nanolines having a width less than 100 nm and a length greater than or equal to 1 μM.

2. The method of claim 1, further comprising removing free-charge on the substrate surface, an ejected printable fluid region, or both, wherein said ejected printable fluid region corresponds to a region between the nozzle and the substrate surface and the free-charge has a polarity that is opposite to the net charge polarity.

3. The method of claim 1, wherein the printing occurs in a dry environment substantially free of counter-ions to the net charge.

4. The method of claim 1, wherein the substrate surface comprises an insulating layer.

5. The method of claim 1, wherein free charge is removed from the substrate surface.

6. The method of claim 1, wherein the generating step comprises applying an electric potential difference between the nozzle and the substrate surface to establish an electrostatic force to said printable fluid in the nozzle, thereby controllably ejecting the printable fluid containing net charge from the nozzle onto the substrate surface.

7. The method of claim 1, wherein the printed pattern of charge on the substrate surface does not substantially degrade over a user-selected time period, wherein the time period is selected from a range that is up to eight days.

8. The method of claim 1, wherein the ejected printable fluid generates a droplet of suspending fluid containing charge.

9. The method of claim 1, wherein the ejected printable fluid comprises a stream of suspending fluid containing charge, wherein substantially all of the suspending fluid evaporates prior to physical contact with the substrate surface.

10. The method of claim 1, wherein the printed pattern of charge has a peak printed potential between 50 mV and 15 V in a positive printing mode or a peak printed potential between −50 mV and −15 V in a negative printing mode.

11. The method of claim 1, further comprising repeating the printing to repeatedly print patterns of charge on the substrate surface.

12. The method of claim 11, wherein the repeated printing step comprises overwriting a previously printed charge region with an opposite charge, resulting in a local region on the substrate surface of reduced or no net charge.

13. The method of claim 12, wherein the overwriting reduces a dimension of a feature of the previously printed pattern of charge.

14. The method of claim 12, wherein the local region of reduced or no net charge has a geometric shape and the geometric shape is a line having a user-selected length and a width.

15. The method of claim 1, wherein the printed charge comprises a charged material selected from the group consisting of ions, polymers, nanomaterials and biologic materials.

16. The method of claim 1, wherein substantially all of the suspending fluid evaporates prior to physical contact with the substrate surface.

17. The method of claim 1, wherein substantially all of the suspending fluid evaporates prior to or after physical contact with the substrate surface.

18. The method of claim 1, further comprising controlling the amount of charge printed to the substrate by controlling the size of a droplet of printable fluid ejected from the nozzle.

19. The method of claim 1, further comprising reversing the net charge polarity during printing, thereby printing a pattern of charge comprising positive charge regions and negative charge regions.

20. The method of claim 1, wherein the printed pattern of charge comprises a feature, wherein the feature has a characteristic dimension that is less than or equal to 10 μm.

21. The method of claim 1, wherein for a post-printing time period selected from a range that is greater than or equal to 7 days, the printed charge maintains a peak printed potential that is within 80% of initial peak printed potential.

22. The method of claim 1, wherein the printed pattern of charge has a charge polarity selected from the group consisting of:

negative charge;

positive charge; and both negative and positive charge.

23. The method of claim 1, further comprising depositing a pattern of material on the substrate surface having the pattern of charge, wherein the deposited material pattern corresponds to the printed pattern of charge.

24. The method of claim 1, wherein the printed pattern of charge affects a physical parameter of the underlying substrate surface.

25. The method of claim 24, wherein the physical parameter is binding affinity to a material; electrostatic attraction or repulsion; or electronic or optoelectronic property.

26. The method of claim 1, wherein the printed pattern of charge is used to provide electrostatic control of an electronic, optoelectronic, photovoltaic or mechanical device.

27. The method of claim 1, further comprising coating the printed pattern of charge on the substrate surface with an encapsulating layer, wherein the encapsulating layer electrically insulates the printed pattern of charge.

28. A functional device made by the process of claim 1.

29. The functional device of claim 28, wherein the functional device is selected from the group consisting of an electronic component; a bioassay device; an anti-counterfitting device; an optoelectronic device, a photovoltaic device, a mechanical device; and a security feature.

30. The method of claim 1, wherein the suspending fluid is a volatile fluid that evaporates during flight from the nozzle to the substrate surface.

31. A method of processing a substrate surface by charge deposition; said method comprising the steps of:

providing a nozzle containing a printable fluid;

providing a substrate having a substrate surface;

generating from the nozzle an ejected printable fluid containing net charge;

directing the ejected printable fluid containing suspending fluid and net charge to the substrate surface, wherein the net charge does not substantially degrade and substantially all the suspending fluid evaporates prior to physical contact with the substrate surface; and retaining the net charge on the substrate surface, wherein the printed charge influences a physical parameter of the substrate surface underlying the printed charge; and the printed pattern of charge comprises a plurality of dots of charge that form nanolines having a width less than 100 nm and a length greater than or equal to 1 μM.

32. The method of claim 31, wherein the substrate comprises silicon.

33. The method of claim 31, wherein the physical parameter is selected from the group consisting of binding affinity; an electronic or optoelectronic property; and electrostatic attraction or repulsion.

* * * * *

UNITED STATES PATENT AND TRADEMARK OFFICE

CERTIFICATE OF CORRECTION

PATENT NO. : 9,057,994 B2
APPLICATION NO. : 12/947120
DATED : June 16, 2015
INVENTOR(S) : Rogers et al.

It is certified that error appears in the above-identified patent and that said Letters Patent is hereby corrected as shown below:

In the claims

Claim 1, column 20, line 8, replace "1 μM" with --1 μm--

Claim 17, column 21, line 16, replace "evaporates prior to or after physical contact" with --evaporates after physical contact--

Claim 31, column 22, line 36, replace "1 μM" with --1 μm--

Signed and Sealed this
Seventeenth Day of November, 2015

Michelle K. Lee

Michelle K. Lee
*Director of the United States Patent and Trademark Office*